US009606464B2

(12) United States Patent
Yamauchi et al.

(10) Patent No.: US 9,606,464 B2
(45) Date of Patent: Mar. 28, 2017

(54) RESIN COMPOSITION FOR TONER, TONER, DEVELOPER AND IMAGE FORMING APPARATUS

(71) Applicants: Yoshitaka Yamauchi, Shizuoka (JP); Kazumi Suzuki, Shizuoka (JP); Tatsuya Morita, Kanagawa (JP); Hiroshi Yamashita, Shizuoka (JP); Tsuyoshi Sugimoto, Shizuoka (JP); Daisuke Asahina, Shizuoka (JP)

(72) Inventors: Yoshitaka Yamauchi, Shizuoka (JP); Kazumi Suzuki, Shizuoka (JP); Tatsuya Morita, Kanagawa (JP); Hiroshi Yamashita, Shizuoka (JP); Tsuyoshi Sugimoto, Shizuoka (JP); Daisuke Asahina, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/409,267

(22) PCT Filed: Jun. 13, 2013

(86) PCT No.: PCT/JP2013/066898
§ 371 (c)(1),
(2) Date: Dec. 18, 2014

(87) PCT Pub. No.: WO2014/002854
PCT Pub. Date: Jan. 3, 2014

(65) Prior Publication Data

US 2015/0153671 A1 Jun. 4, 2015

(30) Foreign Application Priority Data

Jun. 27, 2012 (JP) ..... 2012-144076
Feb. 27, 2013 (JP) ..... 2013-037014

(51) Int. Cl.
*G03G 9/00* (2006.01)
*G03G 9/087* (2006.01)

(52) U.S. Cl.
CPC ..... *G03G 9/08733* (2013.01); *G03G 9/08755* (2013.01); *G03G 9/08795* (2013.01); *G03G 9/08797* (2013.01)

(58) Field of Classification Search
CPC ..... G03G 9/08733; G03G 9/08797; G03G 9/08755; G03G 9/08795
USPC ..... 430/109.4, 123.54, 123.57; 399/252
See application file for complete search history.

(56) References Cited

U.S. PATENT DOCUMENTS

| | | | | |
|---|---|---|---|---|
| 5,324,612 | A * | 6/1994 | Maeda | G03G 9/08755 430/109.4 |
| 2004/0115551 | A1 | 6/2004 | Sugiyama et al. | |
| 2006/0105262 | A1* | 5/2006 | Sata | G03G 9/0804 430/109.4 |
| 2006/0246368 | A1* | 11/2006 | Matsumoto | C08J 3/226 430/109.2 |
| 2010/0062355 | A1 | 3/2010 | Kaya et al. | |
| 2010/0063204 | A1 | 3/2010 | Hamasaki et al. | |
| 2011/0008723 | A1 | 1/2011 | Morita et al. | |
| 2011/0045398 | A1 | 2/2011 | Sekikawa et al. | |
| 2011/0177447 | A1 | 7/2011 | Suzuki et al. | |
| 2012/0082926 | A1 | 4/2012 | Suzuki et al. | |
| 2012/0288791 | A1 | 11/2012 | Sakashita et al. | |
| 2013/0017480 | A1 | 1/2013 | Suzuki et al. | |

FOREIGN PATENT DOCUMENTS

| | | |
|---|---|---|
| EP | 2 085 418 A1 | 8/2009 |
| JP | 2006-171691 | 6/2006 |
| JP | 4079257 | 2/2008 |
| JP | 2012-063478 | 3/2012 |
| RU | 2 397 525 C2 | 8/2010 |

OTHER PUBLICATIONS

Extended European Search Report issued May 28, 2015 in Patent Application No. 13810276.9.
International Search Report issued Aug. 6, 2013, in PCT/JP13/066898 filed Jun. 13, 2013.
Office Action issued Jan. 12, 2016 in Russian Patent Application No. 2015102272/04(003533) (with English language translation).

* cited by examiner

*Primary Examiner* — Thorl Chea
(74) *Attorney, Agent, or Firm* — Oblon, McClelland, Maier & Neustadt, L.L.P.

(57) ABSTRACT

A resin composition for a toner including a polyester resin and a colorant, wherein the polyester resin has A(10)-A(180) of 70 or greater, where A(10) (%) is a transmittance of light having a wavelength of 500 nm through a mixture of 20 parts by mass of the polyester resin added to 80 parts by mass of ethyl acetate and stirred at 25° C. for 10 minutes, and A(180) (%) is the transmittance after the mixture is left to stand for 3 hours.

20 Claims, 2 Drawing Sheets

RESIN COMPOSITION FOR TONER, TONER, DEVELOPER AND IMAGE FORMING APPARATUS

TECHNICAL FIELD

The present invention relates to a resin composition for a toner, a toner, a developer and an image forming apparatus.

BACKGROUND ART

In recent years, there is a large demand for a high-quality image in an image forming apparatus, and a toner with less unevenness in image gloss is requested. Also, there are increasing demands for energy saving during toner fixing and for an image forming apparatus which can be processed at high speed. Thus, a toner having superior low-temperature fixing property and heat-resistant storage stability is desired.

There is a case where a colorant (pigment) included in a color toner and so on is unevenly distributed on a toner surface or forms aggregate due to an interaction with other toner materials. In this case, charging property of the toner is affected, which may result in degraded quality of the obtained image. Thus, in Patent Literature 1, for example, a method of uniformly dispersing the pigment inside the toner using a pigment dispersant is employed.

CITATION LIST

Patent Literature

[PTL1] Japanese Patent (JP-B) No. 4079257

SUMMARY OF INVENTION

Technical Problem

However, the toner of Patent Literature 1 had a problem of insufficient low-temperature fixing property and heat-resistant storage stability.

Thus, the present invention aims at providing a resin composition for a toner for producing a toner having superior pigment dispersibility and having superior low-temperature fixing property and heat-resistant storage stability.

Solution to Problem

The present invention provides a resin composition for a toner, wherein the resin composition for a toner includes a polyester resin and a colorant, and wherein the polyester resin has A(10)-A(180) of 70 or greater, where A(10) (%) is a transmittance of light having a wavelength of 500 nm through a mixture of 20 parts by mass of the polyester resin added to 80 parts by mass of ethyl acetate and stirred at 25° C. for 10 minutes, and A(180) (%) is the transmittance after the mixture is left to stand for 3 hours.

Advantageous Effects of Invention

According to the present invention, a resin composition for a toner for producing a toner having superior pigment dispersibility and superior low-temperature fixing property and heat-resistant storage stability may be provided.

DESCRIPTION OF EMBODIMENTS

Figure 1:
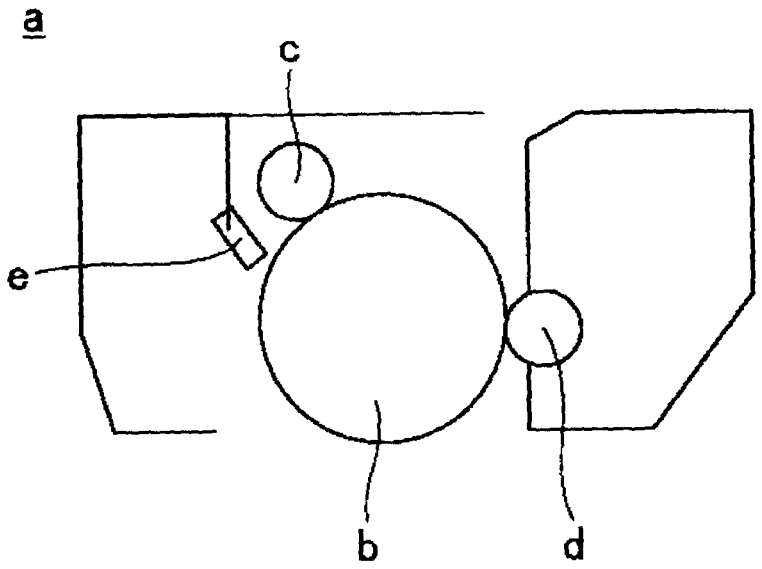
FIG. 1 is a schematic configuration diagram illustrating one example of a process cartridge of an image forming apparatus which uses a toner of the present embodiment.

Hereinafter, the present invention is explained in detail with reference to the drawings.

(Resin Composition for Toner and Toner)

A resin composition for a toner of the present invention includes a polyester resin and a colorant.

The polyester resin has A(10)-A(180) of 70 or greater, where A(10) (%) is a transmittance of light having a wavelength of 500 nm through a mixture of 20 parts by mass of the polyester resin added to 80 parts by mass of ethyl acetate and stirred at 25° C. for 10 minutes, and A(180) (%) is the transmittance after the mixture is left to stand for 3 hours.

The resin composition for a toner of the present invention may be used, for example, as a masterbatch of a toner. Also, the polyester resin included in the resin composition for a toner may be used as a resin for a masterbatch of the toner.

A toner of the present invention includes a first polyester resin and a colorant.

The first polyester resin has A(10)-A(180) of 70 or greater, where A(10) (%) is a transmittance of light having a wavelength of 500 nm through a mixture of 20 parts by mass of the polyester resin added to 80 parts by mass of ethyl acetate and stirred at 25° C. for 10 minutes, and A(180) (%) is the transmittance after the mixture is left to stand for 3 hours.

As the resin for a masterbatch, a resin which has solubility in ethyl acetate varying over time under a condition explained below is used. The condition is A(10)-A(180) of 70 or greater, where A(10) (%) is a transmittance of light having a wavelength of 500 nm measured by a spectrophotometer through a mixture of 20 parts by mass of powder of the resin for a masterbatch added to 80 parts by mass of ethyl acetate and stirred at 25° C. using a magnetic stirrer for 10 minutes, and A(180) (%) is the transmittance after the mixture is left to stand for 3 hours.

There are two possibilities for a polyester resin having a small temporal variation in transmittance and having A(10)-A(180) of less than 70. That is, high solubility in ethyl acetate is maintained over time, or low solubility is maintained over time. In the former case, when the polyester resin having high solubility maintained over time is used as the resin for a masterbatch, the colorant is uniformly dispersed in a solution of a toner material, and the colorant contacts with an aqueous medium the more frequently in the solution during emulsification or dispersion. Therefore, there are cases where the colorant (e.g. lake pigment) elutes. On the other hand, in the latter case, when the resin composition having low solubility maintained over time is used as the resin for a masterbatch, the binder resin and the colorant separate in the toner material solution. The colorant forms a domain such as sea-island structure inside the toner particles, which may result in degraded dispersibility of the colorant. Thus, the obtained toner has degraded color saturation or degree of coloration, and there are cases sufficient hue cannot be obtained.

Also, the polyester resin which satisfies conditions of A(10) of 90(%) or greater and A(180) of 10(%) or less is more preferable.

Among the resins for a masterbatch which satisfy the above-described condition, it is preferable to use a polyester resin, and it is preferable to use aliphatic alcohols and aromatic carboxylic acids (e.g. terephthalic acid) as monomers of the polyester resin. By using the aliphatic alcohols and terephthalic acid as the monomers, it is possible to obtain a toner having appropriate thermal properties, superior low-temperature fixing property and heat-resistant storage stability and favorable pigment dispersibility.

Also, the polyester resin used preferably has a glass transition temperature (Tg) of 55° C. or greater. By using the polyester resin having a Tg of 55° C. or greater, sufficient heat-resistant storage stability may be ensured as the toner.

The aliphatic alcohols are not particularly restricted. Nonetheless, propylene glycol or 1,3-propanediol is preferably used. When a dihydric alcohol having more carbon atoms than propylene glycol and/or 1,3-propanediol is used, an obtained toner does not have sufficient thermal properties, which may resulting degraded heat-resistant storage stability.

When propylene glycol and/or 1,3-propanediol are used, a mixing ratio affects solubility of the resin for a masterbatch in a solvent (ethyl acetate). Thus, a molar ratio of propylene glycol with respect to a total amount of propylene glycol and 1,3-propanediol is preferably 65% to 85%. When the molar ratio of propylene glycol exceeds 85%, the resin for a masterbatch has increased solubility and the transmittance of constantly 90% or greater, which may result in degraded pigment dispersibility. On the other hand, the molar ratio of propylene glycol is below 65%, the resin for a masterbatch has decreased solubility and the transmittance of constantly 10% or less, which may result in domain formation of the colorant inside the toner.

A divalent carboxylic acid used as a monomer of the polyester resin is preferably a monomer (aromatic carboxylic acid) having a rigid skeleton so that the toner to be obtained has sufficient thermal properties. Specifically, it is preferable to use terephthalic acid and/or isophthalic acid, and it is more preferable to use terephthalic acid and isophthalic acid in combination. When terephthalic acid and isophthalic acid are used in combination, solubility of the resin for a masterbatch increases with a higher ratio of isophthalic acid. That is, solubility of the resin for a masterbatch may be appropriately adjusted by those skilled in the art by varying a composition of the alcohol monomer and by varying a composition of the acid monomer.

Here, the transmittance in the present invention may be measured by the above-described method, for example, using a spectrophotometer (JASCO V660).

<Colorant>

The colorant is not particularly restricted, and it may be appropriately selected from heretofore known pigments and dyes according to purpose.

Specific examples of the colorant include carbon black, nigrosine dye, iron black, naphthol yellow S, Hansa Yellow (10G, 5G, G), cadmium yellow, yellow iron oxide, yellow ocher, chrome yellow, titanium yellow, polyazo yellow, Oil Yellow, Hansa Yellow (GR, A, RN, R), Pigment Yellow L, Benzidine Yellow (G, GR), Permanent Yellow (NCG), Vulcan Fast Yellow (5G, R), tartrazine lake, Quinoline Yellow Lake, Anthrazane Yellow BGL, Isoindolinone Yellow, colcothar, red lead, lead vermilion, cadmium red, Cadmium Mercury Red, antimony vermilion, Permanent Red 4R, Para Red, fiser red, para-chloro-ortho-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, bordeaux 5B, Toluidine Maroon, Permanent Bordeaux F2K, Helio Bordeaux BL, bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, Dioxane Violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide and lithopone.

Specific examples of the dyes include C.I. SOLVENT YELLOW (6, 9, 17, 31, 35, 100, 102, 103, 105), C.I. SOLVENT ORANGE (2, 7, 13, 14, 66), C.I. SOLVENT RED (5, 16, 17, 18, 19, 22, 23, 143, 145, 146, 149, 150, 151, 157, 158), C.I. SOLVENT VIOLET (31, 32, 33, 37), C.I. SOLVENT BLUE (22, 63, 78, 83 to 86, 191, 194, 195, 104), C.I. SOLVENT GREEN (24, 25) and C.I. SOLVENT BROWN (3, 9).

Also, commercially available dyes may be used. Examples of the commercially available dyes include: AIZEN SOT DYES Yellow-1, 3, 4, Orange-1, 2, 3, Scarlet-1, Red-1, 2, 3, Brown-2, Blue-1, 2, Violet-1, Green-1, 2, 3, Black-1, 4, 6, 8, manufactured by Hodogaya Chemical Co., Ltd.; SUDAN DYES Yellow-146, 150, Orange-220, Red-290, 380, 460, Blue-670, manufactured by BASF; DIARESIN Yellow-3G, F, H2G, HG, HC, HL, Orange-HS, G, Red-GG, S, HS, A, K, H5B, Violet-D, Blue-J, G, N, K, P, H3G, 4G, Green-C, Brown-A, manufactured by Mitsubishi Chemical Corporation; OIL COLOR Yellow-3G, GG-S, #105, Orange-PS, PR, #201, Scarlet-#308, Red-5B, Brown-GR, #416, Green-BG, #502, Blue-BOS, IIN, Black-HBB, #803, EB, EX, manufactured by Orient Chemical Industries Co., Ltd.; SUMIPLAST Blue GP, OR, Red FB, 3B, Yellow FL7G, GC, manufactured by Sumitomo Chemical Co., Ltd.; KAYALON polyester Black EX-SF300, KAYASET Red-B, Blue A-2R, manufactured by Nippon Kayaku Co., Ltd.

An added amount of the colorant is not particularly restricted, and it may be appropriately selected according to a desired degree of coloration. Nonetheless, it is preferably 1 part by mass to 50 parts by mass with respect to 100 parts by mass the polyester resin pressure-plastic material. Here, the above-described colorant may be used alone or in combination of two or more types.

<Binder Resin>

As a binder resin for the toner of the present invention, it is preferable to use a resin having high solubility to a solvent and having a transmittance defined as described above of constantly 90% or greater. More specifically, it is preferable to use a resin having A(10) of 90(%) or greater and A(180) of 90(%) or greater.

As a specific example of the resin, it is preferable to use a polyester resin, and it is preferable to use a crystalline polyester resin. By using the crystalline polyester resin as the binder resin, a toner having superior low-temperature fixing property may be prepared.

A content of the polyester resin (first polyester resin) as the above-described resin for a masterbatch relative to a content of the polyester resin (second polyester resin) is, as the binder resin is, as a mass ratio (first polyester resin/second polyester resin), preferably in a range of 5/95 to 70/30. Thereby, it is possible to exhibit appropriate pigment dispersibility without impairing greatly toner characteristics derived from the binder resin.

A monomer of the polyester resin for the binder resin is not particularly restricted. Nonetheless, an alcohol component and a carboxylic acid component described below may be used.

Examples of a dihydric alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and a diol obtained by polymerization of bisphenol A with a cyclic ether such as ethylene oxide and propylene oxide.

Examples of a carboxylic acid component of the polyester resin include: benzenedicarboxylic acids such as phthalic acid, isophthalic acid and terephthalic acid, and anhydrides thereof; alkyl dicarboxylic acids such as succinic acid, adipic acid, sebacic acid and azelaic acid, and anhydrides thereof; unsaturated dibasic acids such as maleic acid, citraconic acid, itaconic acid, alkenyl succinic acid, fumaric acid and mesaconic acid; unsaturated dibasic anhydrides such as maleic anhydride, citraconic anhydride, itaconic anhydride and alkenyl succinic anhydride. Among these, in view of heat resistance, it is preferable to use the benzenedicarboxylic acids.

Examples of a polycarboxylic acid component having 3 or more valences include: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, EMPOL trimer acids, anhydrides thereof and partial lower alkyl esters thereof.

(Polyester Prepolymer Having Isocyanate Group)

A polyester prepolymer having an isocyanate group is preferably used in producing the toner of the present embodiment.

The polyester prepolymer having an isocyanate group may be produced by, for example, reacting a terminal carboxyl group or hydroxyl group of the polyester obtained by polycondensation reaction of a polyhydric alcohol and a polycarboxylic acid with a polyvalent isocyanate compound. A content of a component constituting the polyvalent isocyanate compound in the polyester prepolymer having an isocyanate group is usually 0.5% by mass to 40% by mass, preferably 1% by mass to 30% by mass, and more preferably 2% by mass to 20% by mass. When the content of the component constituting the polyvalent isocyanate compound is less than 0.5% by mass, there are cases where hot-offset resistance degrades or it is difficult to obtain both heat-resistant storage stability and low-temperature fixing property. On the other hand, when the content of the component constituting the polyvalent isocyanate compound exceeds 40% by mass, there are cases where low-temperature fixing property degrades.

A number of an isocyanate group included in one molecule of the polyester prepolymer having an isocyanate group is usually 1 or greater, preferably 1.5 to 3 on average, and more preferably 1.8 to 2.5 on average. When the number of the isocyanate group included per one molecule is less than 1, a molecular weight of the urea-modified polyester decreases, which may result in degraded hot-offset resistance.

As amines to be reacted with the polyester prepolymer having an isocyanate group, diamines, polyamines having three or more hydroxyl groups, amino alcohols, aminomercaptans, amino acids and these compounds with an amino group blocked may be used.

Examples of the diamines include: aromatic diamines (e.g. phenylene diamine, diethyltoluene diamine, 4,4'-diaminodiphenylmethane); alicyclic diamines (e.g. 4,4'-diamino-3,3'-dimethyldicyclohexylmethane, diaminecyclohexane, isophorone diamine); and aliphatic diamines (e.g. ethylenediamine, tetramethylene diamine, hexamethylene diamine).

Examples of the polyamines having three or more hydroxyl groups include diethylene triamine and triethylene tetramine.

Examples of the amino alcohols include ethanolamine and hydroxyethyl aniline.

Examples of the aminomercaptans include aminoethyl mercaptan and aminopropylmercaptan.

Examples of the amino acids include aminopropionic acid and aminocaproic acid.

Examples of these compounds with an amino group blocked include a ketimine compound and an oxazoline compound obtained from the above-described amines and ketones (e.g. acetone, methyl ethyl ketone, methyl isobutyl ketone).

Among the above-described amines, the diamines and a mixture of the diamines and a small amount of the polyamines having three or more hydroxyl groups are preferable.

An amount of the amines used is, as an equivalent ratio [NCO]/[NHx] of an isocyanate group in the polyester prepolymer having an isocyanate group [NCO] to an amino group in the amines [NHx], usually 1/2 to 2/1, preferably 1.5/1 to 1/1.5, and more preferably 1.2/1 to 1/1.2. When the [NCO]/[NHx] exceeds 2 or is less than 1/2, the molecular weight of the urea-modified polyester decreases, which may result in degraded hot-offset resistance.

Since the reaction of the isocyanate and the amine involves crosslinking and/or elongation of molecular chains, a molecular weight of the urea-modified polyester to be obtained may be adjusted using a reaction terminator according to necessity.

Examples of the reaction terminator include a monoamine (e.g. diethylamine, dibutylamine, butylamine, laurylamine) and compounds with these blocked (e.g. ketimine compounds).

A reaction time is selected according to a reactivity of the isocyanate group structure included in the polyester prepolymer with the amines. Nonetheless, it is usually 10 minutes to 40 hours, and preferably 2 hours to 24 hours. A reaction temperature is usually 0° C. to 150° C., and preferably 40° C. to 98° C.

Also, heretofore known catalysts described below may be used according to necessity. Specific examples of the catalyst include dibutyltin laurate and dioctyltin laurate.

Also, a mass ratio of the non-modified polyester and the urea-modified polyester is usually 20/80 to 95/5, preferably 70/30 to 95/5, more preferably 75/25 to 95/5, and further preferably 80/20 to 93/7.

When the mass ratio of the urea-modified polyester is less than 5%, there are cases where hot-offset resistance degrades or where both heat-resistant storage stability and low-temperature fixing property cannot be obtained.

<Other Materials>

The toner of the present embodiment may include other materials such as releasing agent, charge controlling agent and external additive according to necessity.

—Releasing Agent—

The releasing agent is not particularly restricted, but waxes may be favorably used, for example. The waxes used have a melting point of preferably 50° C. to 150° C. When the melting point of the wax used as the releasing agent is less than 50° C., the toner may have degraded heat-resistant storage stability. On the other hand, when the melting point of the wax used as the releasing agent exceeds 150° C., the releasing agent does not have a sufficient releasing property, which may result in degraded toner fixability.

Also, a content of the releasing agent is preferably 2% by mass to 15% by mass with respect to the toner. When the content of the releasing agent with respect to the toner is less than 2% by mass, there are cases where the obtained toner has insufficient offset preventing effect. On the other hand, when the content of the releasing agent with respect to the toner exceeds 15% by mass, there are cases where the obtained toner may have degraded transfer property and durability.

The waxes are not particularly restricted. Examples thereof include: low-molecular-weight polyolefin waxes such as low-molecular-weight polyethylene and low-molecular-weight polypropylene; synthetic hydrocarbon waxes such as Fischer-Tropsch wax; natural waxes such as bees wax, carnauba wax, candelilla wax, rice wax and montan wax; petroleum waxes such as paraffin wax and microcrystalline wax; higher fatty acids such as stearic acid, palmitic acid and myristic acid, and metal salts of higher fatty acids, higher fatty acids amides, synthetic ester waxes and various modified waxes thereof. These waxes may be used alone or in combination of two or more types.

Among the above-described waxes, it is preferable to use the carnauba wax and a modified wax thereof, the polyethylene wax and the synthetic ester waxes. Also, pentaerythritol tetrabehenate of the synthetic ester waxes is further preferably used. Since the above-described waxes finely disperse in the polyester resin or the polyol resin, the obtained toner has favorable offset prevention property, transfer property and durability.

—Charge Controlling Agent—

The charge controlling agent is not particularly restricted. Examples thereof include nigrosine dyes, triphenylmethane dyes, chromium-containing metal complex dyes, molybdic acid chelate pigments, rhodamine dyes, alkoxy amines, quaternary ammonium salts (including fluorine-modified quaternary ammonium salts), alkyl amides, elemental phosphorus or phosphorus compounds, elemental tungsten or tungsten compounds, fluorine surfactants, metal salts of salicylic acid and metal salts of salicylic acid derivatives.

Specific examples thereof include: BONTRON 03 of nigrosine dyes, BONTRON P-51 of quaternary ammonium salt, BONTRON S-34 of metal-containing azo dye, E-82 of oxynaphthoic acid metal complex, E-84 of salicylic acid metal complex, E-89 of phenol condensate (all manufactured by Orient Chemical Industries Co., Ltd.); TP-302, TP-415 of quaternary ammonium salt molybdenum complexes (all manufactured by Hodogaya Chemical Co., Ltd.); Copy charge PSY VP2038 of quaternary ammonium salt, Copy blue PR of triphenylmethane derivative, Copy charge NEG VP2036, Copy charge NX VP434 of quaternary ammonium salts (all manufactured by Hoechst); LRA-901, LR-147 as a boron complex (all manufactured by Carlit Japan Co., Ltd.); copper phthalocyanine, perylene, quinacridone, azo pigments, and other polymeric compounds having functional groups such as sulfonic acid group, carboxyl group and quaternary ammonium salt.

A content of the charge controlling agent may be appropriately selected according to desired charge properties of the toner to be produced. Nonetheless, it is preferably 0.1% by mass to 10% by mass, and more preferably 0.2% by mass to 5% by mass with respect to the toner. When the content of the charge controlling agent exceeds 10% by mass, the obtained toner has increased charging property, which may result in degraded effect of the charge controlling agent. Specifically, an electrostatically attractive force with a developing roller increases, which may result in decreased fluidity of a developer or decreased image density. On the other hand, when the content of the charge controlling agent is less than 0.1% by mass, there are cases where the obtained toner has insufficient charge startup properties or charge amount.

—External Additive—

The toner of the present embodiment may be obtained using the polymerization method, where a toner material is subjected to emulsification or suspension dissolution in an aqueous medium for granulation. Thus, an external additive (mainly inorganic particles) may be added for the purpose of enhancing fluidity, storage stability, developing property and transfer property of the toner to be obtained.

A powder mixer is usually used in adding and mixing the external additive, and the mixer is preferably equipped with a jacket for controlling an internal temperature thereof. Here, the additive may be added in the middle or gradually in order to vary a load history applied to the additive. Also, the load history may be varied by varying a rotational speed, a rolling speed, time and temperature of the mixer. Further, regarding the load, a strong load may be applied at the beginning, followed by a relatively weak load; or it may be vice versa. Examples of the mixer in adding a load include a V-type mixer, a rocking mixer, a LOEDIGE mixer, a nauta mixer and a HENSCHEL mixer. After mixing, by passing a sieve of 250 mesh or greater to remove coarse particles and aggregated particles, and thereby, a toner may be obtained.

It is preferable to use inorganic particles as the external additive in view of fluidity, charging property or developing property. The inorganic particles have a primary particle diameter of preferably $5\times10^{-3}$ μm to 2 μm, and more preferably $5\times10^{-3}$ μm to 0.5 μm. Also, a BET specific surface area thereof is preferably 20 $m^2/g$ to 500 $m^2/g$.

An amount of the external additive added with respect to the toner is preferably 0.01% by mass to 5% by mass.

Specific examples of the external additive include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide and silicon nitride.

Also, it is preferable to provide a surface treatment to the external additive for increased hydrophobicity so as to prevent degradation of fluidity and charging property under a high-humidity condition. The surface treatment is provided using a silane coupling agent, a silylating agent, a silane coupling agent having a fluorinated alkyl group, an organic titanate coupling agent, an aluminum-based coupling agent, silicone oil, modified silicone oil and so on, for example.

—Organically Modified Layered Inorganic Mineral—

An organically modified layered inorganic mineral is an organically modified layered inorganic mineral in which at least a part of ions present between layers of a layered inorganic mineral is substituted by an organic ion. The layered inorganic mineral usually denotes a laminated inorganic mineral formed of overlapping layers having a thickness of several nm. Here, "modified" denotes introduction of the organic ion to the ions present between layers of the layered inorganic mineral, and it is intercalation in a broad sense.

The organically modified layered inorganic mineral efficiently enhances a structural viscosity of the binder resin in a vicinity of a surface layer of the toner when it is arranged in the vicinity of the surface layer of the toner, and it can improve stress resistance of the toner.

A state of the organically modified layered inorganic mineral present in the toner may be confirmed by cutting a sample in which the toner particles are embedded in an epoxy resin and so on with a micro microtome or an ultramicrotome and by observing a toner cross-section with a scanning electron microscope (SEM) and so on. In case of observing with the SEM, it is preferable to confirm it by a backscattered electron image since the presence of the organically modified layered inorganic mineral may be observed at a strong contrast. Also, a sample in which the toner particles are embedded in an epoxy resin and so on may be cut by an FIB-STEM (HD-2000, manufactured by Hitachi, Ltd.) and so on for observing a toner cross-section. Here, it is also preferable in this case to confirm it by a backscattered electron image for ease of visible confirmation.

The vicinity of the toner surface in the present invention denotes a region of 0 nm to 300 nm from an outermost surface of the toner to the inside of the toner at an observation image of the toner cross-section obtained by cutting a sample in which the toner particles are embedded in an epoxy resin and so on with a micro microtome, an ultramicrotome or an FIB-STEM.

The layered inorganic compound is not particularly restricted. Nonetheless, examples thereof include: clay minerals of smectite group such as montmorillonite, saponite and hectorite; clay minerals of kaolin group such as kaolinite; and bentonite, attapulgite, magadiite and kanemite. These may be used alone or in combination of two or more types.

The organic ion is not particularly restricted. Nonetheless, examples thereof include: a quaternary ammonium ion, a phosphonium ion and an imidazolium ion; and a sulfate ion, a sulfonate ion, a carboxylic acid ion and a phosphate ion having a skeleton such as branched, non-branched or cyclic alkyl skeleton having 1 to 44 carbon atoms, branched, non-branched or cyclic alkenyl skeleton having 1 to 22 carbon atoms, branched, non-branched or cyclic alkoxy skeleton having 8 to 32 carbon atoms, branched, non-branched or cyclic hydroxyalkyl skeleton having 2 to 22 carbon atoms, ethylene oxide and propylene oxide. These may be used alone or in combination of two or more.

Examples of the quaternary alkylammonium ion include a trimethylstearylammonium ion, a dimethylstearylbenzylammonium ion, a dimethylactadecylammonium ion and an oleyl bis(2-hydroxyethyl)methylammonium ion.

The organically modified layered inorganic compound may be an organically modified layered inorganic compound obtained by introducing inorganic anions by substitution of at least a part of divalent metal ions present between layers with trivalent metal ions and then by substituting at least a part of the inorganic anions with organic anions.

Examples of commercially available products of the organically modified layered inorganic compound include: quaternium 18 bentonite such as BENTONE 3, BENTONE 38, BENTONE 38V (all manufactured by Rheox Corporation), TIXOGEL VP (manufactured by United Catalyst), CLAYTON 34, CLAYTON 40, CLAYTON XL (all manufactured by Southern Clay Products, Inc.); stearalkonium bentonite such as Bentone 27 (manufactured by Rheox Corporation), TIXOGEL LG (manufactured by United Catalyst), CLAYTON AF, CLAYTON APA (all manufactured by Southern Clay Products, Inc.); quaternium 18/benzalkonium bentonite such as CLAYTON HT, CLAYTON PS (all manufactured by Southern Clay Products, Inc.); organically modified montmorillonite such as CLAYTON HY (manufactured by Southern Clay Products, Inc.); and organically modified smectite such as LUCENTITE SPN (manufactured by Co-op Chemical Co., Ltd.).

The organically modified layered inorganic compound may be used as a masterbatch by forming a composite with a resin and so on.

A weight-average particle diameter of the toner of the present embodiment is not particularly restricted. Nonetheless, it is preferably within a range of 3.5 μm to 10 μm in view of obtaining an image having favorable granularity, sharpness and fine-line reproducibility. There is usually a tendency that the smaller particle diameter produces an image having more superior sharpness and fine-line reproducibility. In particular, the toner of the present embodiment preferably has a weight-average particle diameter of 7.5 μm or less for color image formation. On the other hand, the weight-average particle diameter of the toner of less than 3.5 μm may result in degraded fluidity or transfer property of the toner. Here, the weight-average particle diameter of the toner may be measured by a method described below, for example.

<Weight-Average Particle Diameter Dw>

A particle size distribution of the toner may be measured, for example, by a Coulter counter method using COULTER COUNTER TA-II or COULTER MULTISIZER III (all of these products being manufactured by Coulter, Inc.). In the present embodiment, the weight-average particle diameter is measured according to the following method using COULTER MULTISIZER III.

First, 0.1 mL to 5 mL of a surfactant, preferably polyoxyethylene alkyl ether, is added as a dispersant to 100 mL to 150 mL of an aqueous electrolyte solution. In the present embodiment, an about 1-% by mass NaCl aqueous solution is prepared using first-grade sodium chloride as the electrolyte, and ISOTON-II (manufactured by Coulter, Inc.) may be used. Then, 2 mg to 20 mg of a measurement sample is added to the electrolyte. The electrolyte with the measurement sample suspended therein is subjected to dispersion treatment in an ultrasonic disperser for about 1 minute to 3 minutes. By the above-described measurement apparatus, using a 100-μm aperture as an aperture, the volume and the number of particles of the toner particles or the toner are measured, and a volume distribution and a number distribution are calculated. From the obtained distribution, the weight-average particle diameter (Dw) and the number-average particle diameter (Dn) of the toner are calculated.

As channels for measuring the weight-average particle diameter, the following 13 channels are usually used: 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00

μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; and 32.00 μm to less than 40.30 μm. That is, particles having particle diameters of 2.00 μm to less than 40.30 μm are measured.

(Developer)

The toner of the present embodiment can be used as a one-component developer or a two-component developer. The one-component developer is composed of the toner of the present embodiment, and the two-component developer is composed of the toner of the present embodiment and a carrier.

For the one-component developer, the toner of the present embodiment may be used as a non-magnetic one-component toner or a magnetic one-component toner (magnetic toner). When it is used as the magnetic toner, a heretofore known magnetic material is included in the toner for use.

Examples of the magnetic material included in the magnetic toner include: iron oxide such as magnetite, hematite and ferrite; metals such as iron, cobalt and nickel; alloys of these metals with metals such as aluminum, cobalt, copper, lead, magnesium, tin, zinc, antimony, beryllium, bismuth, cadmium, calcium, manganese, selenium, titanium, tungsten and vanadium. These may be used alone or in combination of two or more.

The magnetic material to be used preferably has an average particle diameter of around 0.1 μm to 2 μm. Also, a content of the magnetic material is usually 20 parts by mass to 200 parts by mass with respect to 100 parts by mass of the binder resin, and it is preferably 40 parts by mass to 150 parts by mass with respect to 100 parts by mass of the binder resin.

A carrier used for the two-component developer is not particularly restricted. Nonetheless, a carrier composed of magnetic particles such as iron and ferrite, a resin-coated carrier in which the magnetic particles are coated with a resin, and a binder-type carrier in which magnetic material fine powder is dispersed in a binder resin may be used.

Examples of a raw material of the magnetic material include: iron oxide such as magnetite, hematite and ferrite; metals such as iron, cobalt and nickel; and alloys of these metals with metals such as aluminum, cobalt, copper, lead, magnesium, tin, zinc, antimony, beryllium, bismuth, cadmium, calcium, manganese, selenium, titanium, tungsten and vanadium; and mixtures thereof.

Among the above-described carriers, it is preferable to use a resin-coated carrier including a silicone resin, a copolymer resin (graft resin) of organopolysiloxane and vinyl monomers or a polyester resin uses as the coating resin in view of spent toner. In particular, a carrier coated with a resin obtained by reacting the copolymer resin of organopolysiloxane and vinyl monomers with an isocyanate is more preferable in view of durability, environmental stability and spent resistance. Here, as the vinyl monomer, a monomer having a substituent reactive with an isocyanate such as hydroxyl group is used.

As other carrier coating materials, an amino resin, a urea-formaldehyde resin, a melamine resin, a benzoguanamine resin, a urea resin, a polyamide resin, an epoxy resin and so on may be used. More examples thereof include: polystyrene resins such as polyvinyl and polyvinylidene resins, acrylic resin, polymethyl methacrylate resin, polyacrylonitrile resin, polyvinyl acetate resin, polyvinyl alcohol resin, polyvinyl butyral resin, polystyrene resin and styrene-acrylic copolymer resin; halogenated olefin resins such as polyvinyl chloride; polyester resins such as polyethylene terephthalate resin and polybutylene terephthalate resin; polycarbonate resins, polyethylene resins, polyvinyl fluoride resins, polyvinylidene fluoride resins, polytrifluoroethylene resin, polyhexafluoropropylene resin, copolymers of vinylidene fluoride with acrylic monomers, copolymers of vinylidene fluoride with vinyl fluoride, fluoro-terpolymers such as terpolymers of tetrafluoroethylene, vinylidene fluoride, and non-fluorinated monomers, and silicone resins.

Also, electrically conductive powder and so on may be included in the coating resin as a filler according to necessity. As the electrically conductive powder and so on, metal powder, carbon black, titanium oxide, tin oxide, zinc oxide, aluminum oxide, silica and so on may be used. The electrically conductive powder preferably has an average particle diameter of 1 μm or less. When electrically conductive powder having an average particle diameter exceeding 1 μm is used, there are cases where it becomes difficult to control electrical resistance.

A volume-average particle diameter of the magnetic carrier is preferably 20 μm to 100 μm, and more preferably 20 μm to 60 μm in view of ensuring high image quality and preventing carrier fogging.

<Toner Production Method>

The toner of the present embodiment may be obtained by subjecting the toner materials to emulsification or suspension dissolution in an aqueous medium followed by granulation.

First, the above described colorant and other toner materials are dispersed in an organic solvent, and thereby a toner material solution is prepared.

—Organic Solvent—

As the organic solvent, those preferably used has high volatility, with a boiling point of less than 100° C. in view of easily removing the solvent after formation of the toner base particles. Specific examples thereof include: water-immiscible or water-insoluble organic solvents such as toluene, xylene, benzene, carbon tetrachloride, methylene chloride, 1,2-dichloroethane, 1,1,2-trichloroethane, trichlorethylene, chloroform, monochlorobenzene, dichloroethylidene, methyl acetate and ethyl acetate; and moreover water-miscible or water-soluble organic solvents including lower ketone solvents such as methyl ethyl ketone and methyl isobutyl ketone, cyclic ethers such as tetrahydrofuran, lower alcohol solvents such as methanol and ethanol, and nitrogen-containing organic solvents such as dimethylformamide. These solvents may be used alone or in combination of two or more types. Among the above-described solvents, the ester organic solvents such as methyl acetate and ethyl acetate, the aromatic solvents such as toluene and xylene, and the halogenated hydrocarbon such as methylene chloride, 1,2-dichloroethane, chloroform and carbon tetrachloride are preferably used.

An amount of the organic solvent used is usually 0 parts by mass to 300 parts by mass, preferably 0 parts by mass to 100 parts by mass, and more preferably 25 parts by mass to 70 parts by mass with respect to 100 parts by mass of the above-described polyester prepolymer.

—Aqueous Medium—

The aqueous medium may be water alone or water mixed with an organic solvent such as alcohols (e.g. methanol, isopropyl alcohol and ethylene glycol), dimethylformamide, tetrahydrofuran, CELLOSOLVEs (registered trademark) (e.g. methyl cellosolve) and lower ketones (e.g. acetone and methyl ethyl ketone).

An amount of the aqueous medium used with respect to 100 parts by mass of the toner material solution is usually 50 parts by mass to 2,000 parts by mass, and preferably 100 parts by mass to 1,000 parts by mass. When the amount of the aqueous medium used is less than 50 parts by mass, there are cases where the toner material solution has degraded dispersibility. On the other hand, the amount of the aqueous medium used exceeding 2,000 parts by mass is not economical.

<Surfactant, Resin Particles>

To the aqueous medium, a dispersant such as surfactant and resin particles is preferably added. Addition of the dispersant such as surfactant and resin particles can improve dispersibility of the materials such as colorant, (non-modified) polyester, polyester prepolymer having an isocyanate group and releasing agent.

Examples of the surfactant include: an anionic surfactant such as alkyl benzene sulfonate, α-olefin sulfonate and phosphoric acid ester; a cationic surfactant of an amine salt type such as alkylamine salt, amino alcohol fatty acid derivative, polyamine fatty acid derivative and imidazoline, and a cationic surfactant of a quaternary ammonium salt type such as alkyltrimethyl ammonium salt, dialkyldimethyl ammonium salt, alkyldimethylbenzyl ammonium salt, pyridinium salt, alkyl iso-quinolinium salt and benzethonium chloride; a nonionic surfactant such as fatty acid amide derivative and polyhydric alcohol derivative; an amphoteric surfactant such as alanine, dodecyldi(aminoethyl)glycine, di(octyl aminoethyl)glycine and N-alkyl-N,N-dimethyl ammonium betaine. Among these, a surfactant having a fluoroalkyl group may be favorably used since it exhibits superior dispersibility with a very small amount.

Examples of a favorably used anionic surfactant having a fluoroalkyl group include a fluoroalkylcarboxylic acid having 2 to 10 carbon atoms and a metal salt thereof, disodium perfluorooctanesulfonylglutamate, sodium 3-[omega-fluoroalkyl (C6 to C11) oxy]-1-alkyl (C3 to C4) sulfonate, sodium 3-[omega-fluoroalkanoyl (C6 to C8)-N-ethylamino]-1-propanesulfonate, fluoroalkyl (C11 to C20) carboxylic acid and metal salts thereof, perfluoroalkyl carboxylic acid (C7 to C13) and metal salts thereof, perfluoroalkyl (C4 to C12) sulfonic acid and metal salts thereof, perfluorooctanesulfonic acid diethanolamide, N-propyl-N-(2-hydroxyethyl)perfluorooctanesulfonamide, perfluoroalkyl (C6 to C10) sulfonamide propyltrimethylammonium salts, perfluoroalkyl (C6 to C10)-N-ethylsulfonylglycine salts and monoperfluoroalkyl (C6 to C16) ethylphosphate esters. Examples of commercially available products thereof include: SURFLON S-111, S-112, S-113 (manufactured by Asahi Glass Co., Ltd.); FLUORAD FC-93, FC-95, FC-98, FC-129 (manufactured by Sumitomo 3M Co., Ltd.); UNIDYNE DS-101, DS-102 (manufactured by Daikin Industries, Ltd.); MEGAFACE F-110, F-120, F-113, F-191, F-812, F-833 (manufactured by DIC Corporation); EFTOP EF-102, 103, 104, 105, 112, 123A, 123B, 306A, 501, 201, 204 (manufactured by Tochem Products Inc.); and FTERGENT F-100, F150 (manufactured by Neos Company Ltd.).

Examples of a cationic surfactant having a fluoroalkyl group include aliphatic primary, secondary and tertiary amine acids having a fluoroalkyl group, aliphatic quaternary ammonium salts such as perfluoroalkyl (C6 to C10) sulfonamidepropyltrimethylammonium salts, benzalkonium salts, benzethonium chloride, pyridinium salts, and imidazolinium salts. Examples of commercially available products thereof include SURFLON S-121 (manufactured by Asahi Glass Co., Ltd.); FLUORAD FC-135 (manufactured by Sumitomo 3M Co., Ltd.); UNIDYNE DS-202 (manufactured by Daikin Industries, Ltd.), MEGAFACE F-150, F-824 (manufactured by DIC Corporation); EFTOP EF-132 (manufactured by Tochem Products Inc.); and FTERGENT F-300 (manufactured by Neos Company Ltd.).

The resin particles are not particularly restricted as long as the resin can form an aqueous dispersion, and the resin may be a thermoplastic resin and a thermosetting resin. Specific examples thereof include a vinyl resin, a polyurethane resin, an epoxy resin, a polyester resin, a polyamide resin, a polyimide resin, a silicon-based resin, a phenolic resin, a melamine resin, an urea resin, an aniline resin, an ionomer resin and a polycarbonate resin. These resins may be used alone or in combination of two or more types.

Among the above-described resins, the vinyl resin, the polyurethane resin, the epoxy resin and the polyester resin are preferably used since an aqueous dispersion of fine spherical resin particles may be easily obtained. Examples of the vinyl resin include resins as a polymer obtained by homopolymerization or copolymerization of vinyl monomers such as styrene-(meth)acrylate copolymer, styrene-butadiene copolymer, (meth)acrylic acid-acrylate polymer, styrene-acrylonitrile copolymer, styrene-maleic anhydride copolymer and styrene-(meth)acrylic acid copolymer.

An average particle diameter of the resin particles is usually 5 nm to 300 nm, and preferably 20 nm to 200 nm. An inorganic compound dispersant such as tricalcium phosphate, calcium carbonate, titanium oxide, colloidal silica and hydroxyapatite may be additionally used.

When the above-described resin particles and the inorganic compound dispersant are used, a polymeric protective colloid is used for stabilizing dispersed droplets as a dispersant which may be used further in combination.

In this case, examples of the polymeric protective colloid to be used include: homopolymers or copolymers of acids such as acrylic acid, methacrylic acid, α-cyanoacrylic acid, α-cyanomethacrylic acid, itaconic acid, crotonic acid, fumaric acid, maleic acid and maleic anhydride, (meth) acrylic monomer including a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, n-methylol acrylamide and n-methylol methacrylamide, vinyl alcohols and ethers of vinyl alcohols such as vinyl methyl ether, vinyl ethyl ether and vinyl propyl ether, esters of vinyl alcohols and compounds having a carboxyl group such as vinyl acetate, vinyl propionate and vinyl butyrate, acrylamide, methacrylamide, diacetone acrylamide and methylol compounds thereof, acid chlorides such as acrylic acid chloride and methacrylic acid chloride, and nitrogen-containing compounds such as vinyl pyridine, vinyl pyrrolidone, vinyl imidazole and ethylene imine, and these compounds including a heterocyclic ring; polyoxyethylenes such as polyoxyethylene, polyoxypropylene, polyoxyethylene alkyl amine, polyoxypropylene alkyl amine, polyoxyethylene alkyl amides, polyoxypropylene alkyl amides, polyoxyethylene nonyl phenyl ether, polyoxyethylene laurylphenyl ether, polyoxyethylene stearylphynyl ester and polyoxyethylene nonylphenyl ester; celluloses such as methylcellulose, hydroxymethylcellulose and hydroxypropylcellulose.

—Dispersion Method—

A dispersion method for dispersing the toner material in the organic solvent is not particularly restricted. Nonetheless, a low-speed shearing method, a high-speed shearing method, a frictional method, a high-pressure jet method or an ultrasonic method may be employed. Among these, the high-speed shearing method is preferable since it allows controlling a particle diameter of the dispersing material to 2 μm to 20 μm.

When a high-speed shearing disperser is used, a rotational speed is usually 1,000 rpm to 30,000 rpm, and preferably 5,000 rpm to 20,000 rpm. A dispersion time is not particularly restricted, but for a batch operation, it is preferably 0.1 minutes to 5 minutes. A dispersion temperature is usually 0° C. to 150° C. (under an increased pressure), and preferably 40° C. to 98° C.

In dispersing the toner materials, the above-described amines are added to react with the polyester prepolymer having an isocyanate group.

—Desolvation, Washing, Drying—

After the toner materials are dispersed, the organic solvent is removed from an emulsified dispersion, followed by washing and drying, and thereby, the toner base particles are obtained.

As a method for removing the organic solvent, for example, an entire system is gradually heated with laminar stirring, and desolvation is carried out after sufficient stirring in a certain temperature range. Thereby, spindle-shaped toner base particles are usually prepared.

Also, when a substance soluble to acid and alkali such as calcium phosphate salt is used as a dispersion stabilizer, the calcium phosphate salt may be removed from the toner base particles by dissolving the calcium phosphate salt by acid such as hydrochloric acid followed by rinsing. The calcium phosphate salt may also be removed by an operation of decomposition using an enzyme.

A charge controlling agent is added to the toner base particles obtained by desolvation. Thereafter, inorganic particles such as silica particles and titanium oxide fine particles are adhered on the base particles as an external additive, and thereby, the toner is obtained.

By employing the above-described method, the toner having a small particle diameter and a sharp particle size distribution may be produced. Also, by sufficiently stirring in removing the organic solvent, the produced toner has a shape between a sphere and a rugby ball, and a surface morphology may be controlled from a smooth surface to a wrinkled surface.

—Examination of Elution to Aqueous Medium—

Elution of the toner materials to the aqueous medium may be examined by placing the aqueous medium after granulation in a quartz cell having a layer thickness of 1 cm and by measuring the transmittance at a spectral wavelength of 700 nm to 400 nm using a spectrophotometer V-650 DS manufactured by JASCO Corporation. For example, in measuring a concentration of a magenta colorant, elusion may be determined for a transmittance at a wavelength of 550 nm of 80% or less.

(Image Forming Method and Image Forming Apparatus)

The developer of the present invention is developed by an image forming method including an electrostatic latent image forming step, a developing step, a transfer step and a fixing step. It is preferable that the image forming method further includes a cleaning step of a web system, and it may include a neutralizing step, a recycling step, a controlling step and so on, for example, according to necessity.

An image forming apparatus of the present invention includes: an image bearing member (also referred to as an electrostatic latent image bearing member), a charging unit, an exposure unit, a developing unit and a transfer unit. It is preferable that the image forming apparatus further includes a cleaning unit, and it may include a neutralizing unit, a recycling unit, a controlling unit and so on, for example, according to necessity.

The developing unit is provided with the toner, and it develops an electrostatic latent image on the image bearing member using the toner.

<Electrostatic Latent Image Forming Step, Image Bearing Member, Charging Unit, Exposure Unit>

The electrostatic latent image forming step is a step for forming an electrostatic latent image on the electrostatic latent image bearing member such as photoconductive insulator and photoconductor. A material, a shape, a structure, a size and so on of the electrostatic latent image bearing member are not particularly restricted, and it may be appropriately selected from heretofore known ones. The shape of the electrostatic latent image bearing member is preferably a drum shape. Also, examples of the photoconductor include an inorganic photoconductor such as amorphous silicon and selenium and an organic photoconductor such as polysilane and phthalopolymethine. Among these, it is preferable to use the amorphous silicon photoconductor in view of long life.

The electrostatic latent image is formed, for example, by uniformly charging a surface of the electrostatic latent image bearing member followed by image-wise exposure. That is, an electrostatic latent image forming unit includes, for example, a charger as a charging unit which uniformly charges the surface of the electrostatic latent image bearing member by applying a voltage and an exposure device as an exposure unit which carries out image-wise exposure on the surface of the electrostatic latent image bearing member.

The charger is not particularly restricted. Nonetheless, examples thereof include: heretofore known contact chargers equipped with an electrically conductive or semiconductive roller, brush, film, rubber blade and so on; and a non-contact chargers which use corona discharge such as corotron and scorotron.

The exposure device is not particularly restricted as long as it can expose imagewise an image to be formed on the surface of the electrostatic latent image bearing member charged by the charger. Nonetheless, examples thereof include various exposure devices such as duplication optical system, rod lens array system, laser optical system and liquid-crystal shutter optical system. Here, a back light system which exposes imagewise from a back side of the electrostatic latent image bearing member may be adopted.

<Developing Step, Developing Unit>

The developing step is a step for developing the electrostatic latent image formed on the electrostatic latent image forming step using a developer to form a visible image. The developing unit is not particularly restricted as long as the development is carried out using the toner or the developer of the present invention. Nonetheless, for example, those including a developing device which contains the toner or the developer of the present invention and can impart the toner to the electrostatic latent image in a contact or non-contact manner may be used. Also, a developing device which is integrally provided with a developer container is preferable.

The developing device may employ a dry developing system or a wet developing system. Also, the developing device may be a developing device for a single color, or a developing device for multicolor. Examples thereof include a developing device containing a stirrer for rubbing and stirring to charge the developer of the present invention and a rotatable magnet roller. The toner and the carrier are mixed and stirred in the developing device, for example. The toner is charged by a friction thereby and maintained on a surface of the rotating magnet roller as a chain of magnetic particles, and a magnetic brush is formed. The magnet roller is arranged near the electrostatic latent image bearing member, and thus a part of the toner which constitutes the magnetic brush formed on the surface of the magnet roller moves to the surface of the electrostatic latent image bearing member due to an electrically attractive force. As a result, the electrostatic latent image is developed by the toner, and a visible image is formed on the surface of the electrostatic latent image bearing member. Here, the developer contained in the developing device may be a one-component developer or a two-component developer.

<Transfer Step, Transfer Unit>

The transfer step is a step, for example, for charging the electrostatic latent image bearing member on which the toner image has been formed using a transfer charger to transfer the toner image on a recording medium. The transfer step preferably includes: a primary transfer step which transfers the toner image on an intermediate transfer member; and a secondary transfer step which transfers the toner image transferred on the intermediate transfer member on the recording medium. Also, the transfer step more preferably includes: a primary transfer step which uses toners of two or more colors, preferably full-color toners, and transfers the toner images of the respective colors on the intermediate transfer member to form a composite toner image; and a secondary transfer step which transfers the composite toner image formed on the intermediate transfer member on the recording medium.

The transfer unit preferably includes: a primary transfer unit which transfers the toner images on the intermediate transfer member to form the composite toner image; and a secondary transfer unit which transfers the composite toner image formed on the intermediate transfer member on the recording medium. Here, the intermediate transfer member is not particularly restricted, but examples thereof include an endless transfer belt. Also, the transfer unit preferably includes a transfer device which peels off and charges the toner image formed on the electrostatic latent image bearing member to the side of the recording medium. Here, the transfer unit may include one transfer device, or two or more transfer devices.

Examples of the transfer device include a corona transfer device by corona discharge, a transfer belt, a transfer roller, a pressure transfer roller and an adhesive transfer device.

Here, the recording medium is not particularly restricted, and it may be appropriately selected from heretofore known recording medium such as recording paper.

<Fixing Step, Fixing Unit>

The fixing step is a step for fixing the toner image which has been transferred on the recording medium. Here, when the toners of two or more colors is used, fixing may be carried out each time the toner of a respective color is transferred on the recording medium, or fixing may be carried out once after the toners of all the colors are transferred and laminated on the recording medium. The fixing unit is not particularly restricted, and heretofore known heating and pressurizing unit may be used. Examples of the heating and pressurizing unit include a combination of a heat roller and a pressure roller and a combination of a heat roller, a pressure roller and an endless belt. At this time, a heating temperature is usually 80° C. to 200° C.

When the toner and so on is adhered and accumulated on circumferential surfaces of the fixing roller and the pressure roller in a heat-roller fixing apparatus, fixability degrades, causing further accumulation of the adhered toner. Therefore, various methods to clean appropriately the circumferential surfaces of the fixing roller and the pressure roller have been conventionally proposed. Heretofore known methods include: a roller method which contacts a cleaning member to the circumferential surfaces of the fixing roller and the pressure roller; a felt method which contacts a cleaning member formed of a felt to the fixing roller and the pressure roller in a sliding manner; and further a web method which cleans the circumferential surfaces of the fixing roller and the pressure roller in the course of winding a web wound on a delivery roller with a winding roller.

In the present invention, it is preferable to arrange a cleaning member on the pressure roller and to adopt the web method.

<Neutralizing Step, Neutralizing Unit>

The neutralizing step is a step for neutralizing the electrostatic latent image bearing member by applying a neutralizing bias. The neutralizing unit is not particularly restricted as long as it can apply the neutralizing bias on the electrostatic latent image bearing member, a neutralizing lamp and so on may be used, for example.

<Cleaning Step, Cleaning Unit>

The cleaning step is a step for removing the toner remaining on the electrostatic latent image bearing member. As the cleaning unit, a web cleaner may be used.

<Recycling Step, Recycling Unit>

The recycling step is a step for recycling the toner removed by the cleaning step to the developing unit. The recycling unit is not particularly restricted, and heretofore known conveying units and so on may be used.

<Controlling Step, Controlling Unit>

The controlling step is a step for controlling the above steps. The controlling unit is not particularly restricted as long as it controls operations of the each unit, and, for example, a sequencer or a computer may be used.

The image forming method of the present embodiment provides superior low-temperature fixing property and heat-resistant storage stability even in a high-speed image formation and causes no offset phenomenon since it uses the above-described toner of the present embodiment. Also, since it uses the toner for image formation fixed only at a desired location of the recording medium, a high-quality image having superior gloss and almost no occurrences of ghost may be stably output even in an image formation by an image forming apparatus of a fast output electrophotographic system.

(Process Cartridge)

In an image formation by the above-described image forming method, an image forming unit may be incorporated and fixed in a copying machine, a facsimile or a printer, or it may be incorporated in these apparatuses in a form of a process cartridge.

The process cartridge is a device (component) including a built-in image bearing member (photoconductor) and including the charging unit, the exposure unit, the developing unit, the transfer unit or the cleaning unit, or any combination thereof. It may further include other units such as neutralizing unit according to necessity.

FIG. 1 is a schematic diagram illustrating a structure of an image forming apparatus equipped with a process cartridge. In FIG. 1, "a" denotes the entire process cartridge; "b" denotes a photoconductor; "c" denotes a charging unit; "d" denotes a developing unit; "e" denotes a cleaning unit.

In the example of the process cartridge, among the structural elements of the above-described photoconductor "b", charging unit "c", developing unit "d" and cleaning unit "e", at least the photoconductor "b" and the developing unit "d" are integrally bound and configured as the process cartridge, and this process cartridge is detachably mounted on an image forming apparatus main body such as copying machine and printer.

Since the above-described toner of the present embodiment is supplied to the process cartridge of the present embodiment, it is possible to output a high-quality image fixed stably only at a desired location of the recording medium without occurrences of an offset phenomenon by a non-fixed image in the fixing unit. Also, the process cartridge provides easy storage and transport and superior handling property.

(Color Image Forming Apparatus)

In the present invention, a color image forming apparatus of a tandem developing system may be used, where at least four (4) developing units of different developing colors are arranged in series. One example of an embodiment of the tandem color image forming apparatus is explained. An image forming apparatus of the present embodiment may be of a direct transfer method, where an image on each photoconductor is sequentially transferred by a transfer apparatus to a sheet conveyed by a sheet conveying belt, or it may be of an indirect transfer method, where an image on each photoconductor is sequentially transferred once on the intermediate transfer member by a primary transfer apparatus, and then the image on the intermediate transfer member is collectively transferred on a sheet by a secondary transfer apparatus.

Hereinafter, this embodiment of the present invention is explained with reference to a figure.

Figure 2:
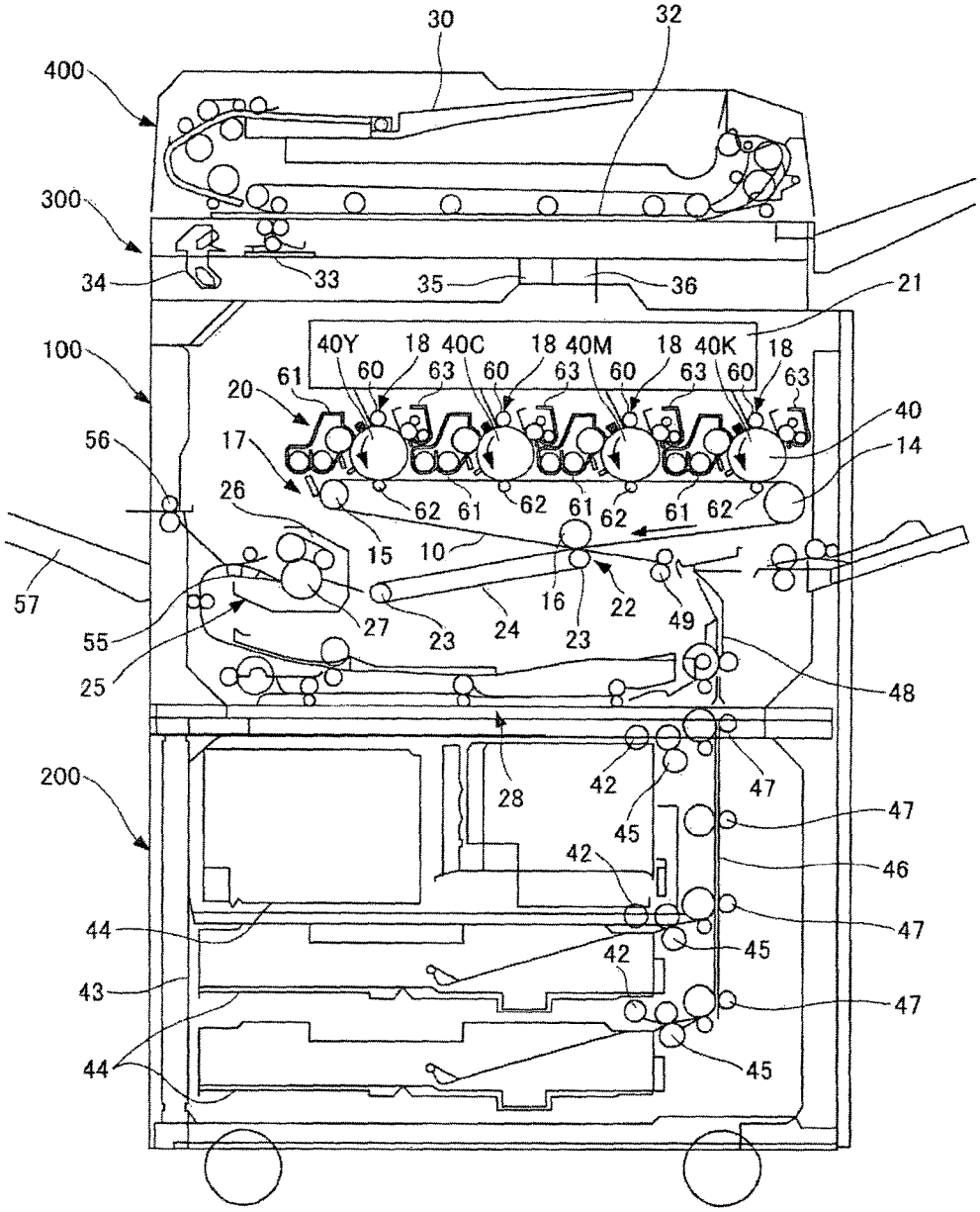
FIG. 2 is a schematic configuration diagram illustrating one example of an image forming apparatus of the present embodiment.

FIG. 2 illustrates one embodiment of the present invention, and it is an electrophotographic apparatus of a tandem indirect transfer method. In the figure, a reference numeral 100 denotes a copying apparatus main body; 200 denotes a paper feed table on which the main body is mounted; 300 denotes a scanner installed on the copying apparatus main body 100; and 400 denotes an automatic document feeder (ADF) installed further thereon. An intermediate transfer member 10 as an endless belt is disposed at a center of the copying apparatus main body 100.

Also, as illustrated in FIG. 2, it may be rotationally transported in clockwise direction in the figure by being stretched over three (3) support rollers 14, 15 and 16 in the illustrated example.

In this illustrated example, an intermediate transfer member cleaning apparatus 17, which removes a residual toner remaining on the intermediate transfer member 10 after image transfer, is disposed to the left of the second support roller 15 among the three rollers.

Also, on the intermediate transfer member 10 stretched between the first support roller 14 and the second support roller 15 among the 3 rollers, four (4) image forming units 18 of yellow, cyan, magenta and black are disposed side-by-side along its conveying direction to configure a tandem image forming apparatus 20.

An exposure apparatus 21 is disposed on the tandem image forming apparatus 20, as illustrated in FIG. 2. Meanwhile, a secondary transfer apparatus 22 is equipped on a side opposite to the tandem image forming apparatus 20 across the intermediate transfer member 10. In the illustrated example, the secondary transfer apparatus 22 includes a secondary transfer belt 24 as an endless belt stretched between two (2) rollers 23, and it is disposed by being pressed on the third support roller 16 via the intermediate transfer member 10 to transfer an image on the intermediate transfer member 10 to a sheet.

A fixing apparatus 25 for fixing a transfer image on the sheet is disposed on a side of the secondary transfer apparatus 22. The fixing apparatus 25 is configured with a pressure roller 27 pressed against a fixing belt 26 as an endless belt.

The above-described secondary transfer apparatus 22 also has a sheet conveying function to convey the sheet after image transfer to this fixing apparatus 25. Of course, a transfer roller or a non-contact charger may be arranged as the secondary transfer apparatus 22, and in such a case, it is difficult to provide the sheet conveying function as well.

Here, in the illustrated example, a sheet inverting apparatus 28 for inverting the sheet for recording images on both sides of the sheet is provided in parallel with the above-described tandem image forming apparatus 20 below this secondary transfer apparatus 22 and the fixing apparatus 25.

Now, a document is photocopied using this color electrophotographic apparatus, and the document is placed on the a document table 30 on the automatic document feeder 400. Alternatively, the automatic document feeder 400 is opened, the document is placed on a contact glass 32 of the scanner 300, and the automatic document feeder 400 is closed to press it.

A start switch (not shown) is pressed. The scanner 300 is driven after the document is conveyed onto the contact glass 32 in case the document is placed on the automatic document feeder 400, or immediately in case the document is placed on the contact glass 32, and a first traveling body 33 and a second travelling body 34 travel. Then, a light from a light source is irradiated by the first traveling body 33, and at the same time, the light reflected from a surface of the document is reflected by a mirror in the first traveling body 33 to the second travelling body 34. The light is received by a read sensor 36 through an imaging lens 35, and a content of the document is read. Also, one of the support rollers 14, 15 and 16 is rotationally driven by a drive motor not shown, and the other two support rollers are rotatably driven as well. Thereby, the intermediate transfer member 10 is rotated and conveyed. At the same time, in each image forming unit 18, a respective photoconductor 40 is rotated so as to form a single-color image of black, yellow, magenta or cyan on the photoconductor 40. Then, these single-color images are sequentially transferred along with conveyance of the intermediate transfer member 10, and a composite color image is formed on the intermediate transfer member 10. Further, one of paper-feed rollers 42 in the paper feed table 200 is selectively rotated to feed a sheet from one of paper cassettes 44 provided in multiple stages in a paper bank 43. The sheet is separated one-by-one by separation rollers 45 and sent to a feed path 46. It is conveyed by conveying rollers 47 and guided to a feed path 48 in the copying machine main body 100, and the sheet stops when it strikes a registration roller 49.

Then, the sheet is sent between the intermediate transfer member 10 and the secondary transfer apparatus 22 by timely rotating the registration roller 49, and the composite color image formed on the intermediate transfer member 10 is transferred on the secondary transfer apparatus 22. Thereby, the color image is recorded on the sheet.

The sheet after image transfer is conveyed by the secondary transfer apparatus 22 and sent to the fixing apparatus 25, and the transfer image is fixed with an application of heat and pressure in the fixing apparatus 25. Then, the sheet is switched by a switching claw 55, discharged in a discharge roller 56 and stacked on a discharge tray 57. Alternatively, it is switched by the switching claw 55 to the sheet inverting apparatus 28, inverted there and guided again to a transfer position. Then, an image is recorded on a back side as well, and the sheet is discharged by the discharge roller 56 on the discharge tray 57.

Meanwhile, the intermediate transfer member 10 after image transfer removes a residual toner remaining on the intermediate transfer member 10 after image transfer using the intermediate transfer member cleaning apparatus 17, and it prepares for the next image formation by the tandem image forming apparatus 20.

Here, in general, the registration roller 49 is often used in a grounded state, but a bias may be applied thereto for removing paper dust of the sheet.

Here, in the above-described tandem image forming apparatus 20, specifically, each image forming unit 18 is equipped with a charging apparatus 60, a developing apparatus 61, a primary transfer apparatus 62, a photoconductor cleaning apparatus 63 and a neutralization apparatus not shown around a drum-shaped photoconductor 40.

EXAMPLES

Hereinafter, the present invention is explained further in detail with reference to examples.

Production Example 1-1

Synthesis of Resin for Masterbatch 1

A reactor equipped with a cooling tube, a stirrer and a nitrogen inlet tube was charged with: 326 parts by mass of dimethyl terephthalate; 138 parts by mass of propylene glycol; 15 parts by mass of 1,3-propanediol; and 1.4 parts by mass of titanium dihydroxybis(triethanolaminate) as a polycondensation catalyst, and it was reacted at 180° C. under a stream of nitrogen for 8 hours with generated methanol distilled.

Next, while heating until the temperature reached 235° C., it was reacted for 4 hours under a stream of nitrogen with generated methanol distilled. Further, the pressure was reduced to 5 mmHg to 20 mmHg, and it was reacted under the reduced pressure until a Mw reached approximately 10,000. Thereby, (Resin for Masterbatch 1) was obtained.

Production Example 1-2

Synthesis of Resin for Masterbatch 2

(Resin for Masterbatch 2) was obtained by the same method as the synthesis of Resin for Masterbatch 1 except that the amount of propylene glycol and the amount of 1,3-propanediol used were changed to 130 parts by mass and 23 parts by mass, respectively.

Production Example 1-3

Synthesis of Resin for Masterbatch 3

(Resin for Masterbatch 3) was obtained by the same method as the synthesis of Resin for Masterbatch 1 except that the amount of propylene glycol and the amount of 1,3-propanediol used were changed to 115 parts by mass and 38 parts by mass, respectively.

Production Example 1-4

Synthesis of Resin for Masterbatch 4

(Resin for Masterbatch 4) was obtained by the same method as the synthesis of Resin for Masterbatch 1 except that the amount of propylene glycol and the amount of 1,3-propanediol used were changed to 100 parts by mass and 54 parts by mass, respectively.

Production Example 1-5

Synthesis of Resin for Masterbatch 5

(Resin for Masterbatch 5) was obtained by the same method as the synthesis of Resin for Masterbatch 1 except that the amount of propylene glycol and the amount of 1,3-propanediol used were changed to 95 parts by mass and 48 parts by mass, respectively.

Production Example 1-6

Synthesis of Resin for Masterbatch 6

(Resin for Masterbatch 6) was obtained by the same method as the synthesis of Resin for Masterbatch 1 except that the amount of propylene glycol, the amount of 1,3-propanediol and the amount of dimethyl terephthalate used were changed to 95 parts by mass, 48 parts by mass and 244 parts by mass, respectively, and that 82 parts by mass of dimethyl isophthalate was added.

Production Example 1-7

Synthesis of Resin for Masterbatch 7

A reactor equipped with a cooling tube, a stirrer and a nitrogen inlet tube was charged with: 317 parts by mass of dimethyl terephthalate; 61 parts by mass of ethylene glycol; 102 parts by mass of neopentyl glycol; and 1.4 parts by mass of titanium dihydroxybis(triethanolaminate) as a polycondensation catalyst, and it was reacted at 180° C. under a stream of nitrogen for 8 hours with generated methanol distilled.

Next, while heating until the temperature reached 235° C., it was reacted for 4 hours under a stream of nitrogen with generated methanol distilled. Further, the pressure was reduced to 5 mmHg to 20 mmHg, and it was reacted under the reduced pressure until a Mw reached approximately 10,000. Thereby, (Resin for Masterbatch 7) was obtained.

Production Example 1-8

Synthesis of Resin for Masterbatch 8

A reactor equipped with a cooling tube, a stirrer and a nitrogen inlet tube was charged with: 308 parts by mass of dimethyl terephthalate; 72 parts by mass of 1,3-propanediol; 99 parts by mass of neopentyl glycol; and 1.4 parts by mass of titanium dihydroxybis(triethanolaminate) as a polycondensation catalyst, and it was reacted at 180° C. under a stream of nitrogen for 8 hours with generated methanol distilled.

Next, while heating until the temperature reached 235° C., it was reacted for 4 hours under a stream of nitrogen with generated methanol distilled. Further, the pressure was reduced to 5 mmHg to 20 mmHg, and it was reacted under the reduced pressure until a Mw reached approximately 10,000. Thereby, (Resin for Masterbatch 8) was obtained.

Production Example 1-9

Synthesis of Resin for Masterbatch 9

A reactor equipped with a cooling tube, a stirrer and a nitrogen inlet tube was charged with: 157 parts by mass of dimethyl terephthalate; 155 parts by mass of ethylene oxide 2-mole adduct of bisphenol A; 168 parts by mass of propylene oxide 2-mole adduct of bisphenol A; and 1.4 parts by mass of titanium dihydroxybis(triethanolaminate) as a polycondensation catalyst, and it was reacted at 180° C. under a stream of nitrogen for 8 hours with generated methanol distilled.

Next, while heating until the temperature reached 235° C., it was reacted for 4 hours under a stream of nitrogen with generated methanol distilled. Further, the pressure was reduced to 5 mmHg to 20 mmHg, and it was reacted under the reduced pressure until a Mw reached approximately 10,000. Thereby, (Resin for Masterbatch 9) was obtained.

Production Example 1-10

Synthesis of Resin for Masterbatch 10

A reactor equipped with a cooling tube, a stirrer and a nitrogen inlet tube was charged with: 300 parts by mass of dimethyl terephthalate; 35 parts by mass of 1,3-propanediol; 144 parts by mass of neopentyl glycol; and 1.4 parts by mass of titanium dihydroxybis(triethanolaminate) as a polycondensation catalyst, and it was reacted at 180° C. under a stream of nitrogen for 8 hours with generated methanol distilled.

Next, while heating until the temperature reached 235° C., it was reacted for 4 hours under a stream of nitrogen with generated methanol distilled. Further, the pressure was reduced to 5 mmHg to 20 mmHg, and it was reacted under the reduced pressure until a Mw reached approximately 10,000. Thereby, (Resin for Masterbatch 10) was obtained.

Production Example 2

Synthesis of Polyester Resin 1

A reactor equipped with a cooling tube, a stirrer and a nitrogen inlet tube was charged with: 326 parts by mass of dimethyl terephthalate; 154 parts by mass of propylene glycol; and 1.4 parts by mass of titanium dihydroxybis (triethanolaminate) as a polycondensation catalyst, and it was reacted at 180° C. under a stream of nitrogen for 8 hours with generated methanol distilled.

Next, while heating until the temperature reached 235° C., it was reacted for 4 hours under a stream of nitrogen with generated methanol distilled. Further, the pressure was reduced to 5 mmHg to 20 mmHg, and it was reacted under the reduced pressure until a Mw reached approximately 10,000. Thereafter, 16 parts by mass of trimellitic anhydride was added, and it was reacted at 180° C. for 2 hours. Thereby, (Polyester Resin 1) was obtained.

Production Example 3-1

Synthesis of Crystalline Resin 1

A reactor equipped with a cooling tube, a stirrer and a nitrogen inlet tube was charged with: 241 parts by mass of sebacic acid; 31 parts by mass of adipic acid; 164 parts by mass of 1,4-butanediol; and 0.75 parts by mass of titanium dihydroxybis(triethanolaminate) as a polycondensation catalyst, and it was reacted at 180° C. under a stream of nitrogen for 8 hours with generated water distilled.

Next, while gradually heating until the temperature reached 225° C., it was reacted for 4 hours under a stream of nitrogen with generated water and 1,4-butanediol distilled. Further, the pressure was reduced to 5 mmHg to 20 mmHg, and it was reacted under the reduced pressure until a Mw reached approximately 18,000. Thereby, a crystalline polyester resin having a melting point of 58° C. (Crystalline Resin 1) was obtained.

Production Example 3-2

Synthesis of Crystalline Resin 2

A reactor equipped with a cooling tube, a stirrer and a nitrogen inlet tube was charged with: 241 parts by mass of sebacic acid; 31 parts by mass of adipic acid; 164 parts by mass of 1,4-butanediol; and 0.75 parts by mass of titanium dihydroxybis(triethanolaminate) as a polycondensation catalyst, and it was reacted at 180° C. under a stream of nitrogen for 8 hours with generated water distilled.

Next, while gradually heating until the temperature reached 225° C., it was reacted for 4 hours under a stream of nitrogen with generated water and 1,4-butanediol distilled. Further, the pressure was reduced to 5 mmHg to 20 mmHg, and it was reacted under the reduced pressure until a Mw reached approximately 6,000.

Then, 218 parts by mass of an obtained crystalline resin were moved in a reactor equipped with a cooling tube, a stirrer and a nitrogen inlet tube, and with an addition of 250 parts by mass of ethyl acetate, 8.6 parts by mass of hexamethylene diisocyanate (HDI), it was reacted at 80° C. for 5 hours under a stream of nitrogen. Next, ethyl acetate was removed under a reduced pressure. Thereby, a crystalline polyurethane resin having a Mw of approximately 22,000 and a melting point of 60° C. (Crystalline Resin 2) was obtained.

Physical properties (weight-average molecular weight (Mw), melting point (m.p.) and glass transition temperature (TO) and results of the transmittance measurement by the above-described method of obtained (Resins for Masterbatch 1 to 10), (Polyester Resin 1), (Crystalline Resins 1, 2) are shown in Table 1.

TABLE 1

| | Physical properties | | | Transmittance | |
|---|---|---|---|---|---|
| | Mw | m.p. (° C.) | Tg (° C.) | A(10) (%) | A(180) (%) |
| Resin for Masterbatch 1 | 9,800 | — | 70 | 97 | 93 |
| Resin for Masterbatch 2 | 10,100 | — | 68 | 98 | 3 |
| Resin for Masterbatch 3 | 9,700 | — | 66 | 95 | 1 or less |
| Resin for Masterbatch 4 | 9,600 | — | 64 | 94 | 1 or less |
| Resin for Masterbatch 5 | 9,900 | — | 61 | 1 or less | 1 or less |
| Resin for Masterbatch 6 | 9,700 | — | 60 | 73 | 1 or less |
| Resin for Masterbatch 7 | 10,200 | — | 57 | 86 | 1 or less |
| Resin for Masterbatch 8 | 11,000 | — | 46 | 91 | 1 or less |
| Resin for Masterbatch 9 | 10,300 | — | 78 | 91 | 1 or less |
| Resin for Masterbatch 10 | 10,000 | — | 48 | 98 | 33 |
| Polyester resin 1 | 10,500 | — | 72 | 97 | 96 |
| Crystalline Resin 1 | 17,800 | 58 | — | — | — |
| Crystalline Resin 2 | 22,000 | 60 | — | — | — |

Production Example 4

Synthesis of Polyester Prepolymer Having Isocyanate Group

A reactor equipped with a cooling tube, a stirrer and a nitrogen inlet tube was charged with: 321 parts by mass of dimethyl terephthalate; 151 parts by mass of propylene glycol; 8 parts by mass of trimellitic anhydride; and 1.4 parts by mass of titanium dihydroxybis(triethanolaminate) as a polycondensation catalyst, and it was reacted at 180° C. under a stream of nitrogen for 8 hours with generated methanol distilled.

Next, while heating until the temperature reached 235° C., it was reacted for 4 hours under a stream of nitrogen with generated methanol distilled. Further, the pressure was reduced to 5 mmHg to 20 mmHg, and it was reacted under the reduced pressure until a Mw reached approximately 10,000. Thereby, (Intermediate Polyester) was synthesized.

Next, a reactor equipped with a cooling tube, a stirrer and a nitrogen inlet tube was charged with: 410 parts by mass of (Intermediate Polyester); 89 parts by mass of isophorone diisocyanate; and 500 parts by mass of ethyl acetate, and it was reacted at 100° C. for 5 hours. Thereby, (Prepolymer 1) was obtained.

Production Example 5

Synthesis of Ketimine

A reactor equipped with a stirring rod and a thermometer was charged with 170 parts by mass of isophoronediamine and 75 parts by mass of methyl ethyl ketone, which was reacted at 50° C. for 5 hours. Thereby, (Ketimine Compound 1) was obtained.

Comparative Example 1

Production of Masterbatch 1

First, 18 parts by mass of a rhodamine pigment (7050, manufactured by Daido Chemical Corporation) and 82 parts by mass of (Resin for Masterbatch 1) were mixed at 1,500 rpm for 3 minutes using a HENSCHEL mixer (HENSCHEL 20B, manufactured by Mitsui Mining Co., Ltd.). Then, it was kneaded in a uniaxial kneading machine (Compact Buss Co-Kneader, manufactured by Buss, Inc.) under conditions of setting temperatures at an inlet of 90° C. and an outlet of 60° C. and a feed rate of 10 kg/hr. Thereby, (Masterbatch 1) was obtained.

Example 1

Production of Masterbatch 2

(Masterbatch 2) was obtained in the same manner as [Production of Masterbatch 1] except that (Resin for Masterbatch 1) was changed to (Resin for Masterbatch 2).

Example 2

Production of Masterbatch 3

(Masterbatch 3) was obtained in the same manner as [Production of Masterbatch 1] except that (Resin for Masterbatch 1) was changed to (Resin for Masterbatch 3).

Example 3

Production of Masterbatch 4

(Masterbatch 4) was obtained in the same manner as [Production of Masterbatch 1] except that (Resin for Masterbatch 1) was changed to (Resin for Masterbatch 4).

Comparative Example 2

Production of Masterbatch 5

(Masterbatch 5) was obtained in the same manner as [Production of Masterbatch 1] except that (Resin for Masterbatch 1) was changed to (Resin for Masterbatch 5).

Example 4

Production of Masterbatch 6

(Masterbatch 6) was obtained in the same manner as [Production of Masterbatch 1] except that (Resin for Masterbatch 1) was changed to (Resin for Masterbatch 6).

Example 5

Production of Masterbatch 7

(Masterbatch 7) was obtained in the same manner as [Production of Masterbatch 1] except that (Resin for Masterbatch 1) was changed to (Resin for Masterbatch 7).

Example 6

Production of Masterbatch 8

(Masterbatch 8) was obtained in the same manner as [Production of Masterbatch 1] except that (Resin for Masterbatch 1) was changed to (Resin for Masterbatch 8).

Example 7

Production of Masterbatch 9

(Masterbatch 9) was obtained in the same manner as [Production of Masterbatch 1] except that (Resin for Masterbatch 1) was changed to (Resin for Masterbatch 9).

Comparative Example 3

Production of Masterbatch 10

(Masterbatch 10) was obtained in the same manner as [Production of Masterbatch 1] except that (Resin for Masterbatch 1) was changed to (Resin for Masterbatch 10).

Example 8

Production of Masterbatch 11

First, 39 parts by mass of a rhodamine pigment (7050, manufactured by Daido Chemical Corporation) and 61 parts by mass of (Resin for Masterbatch 3) were mixed at 1,500 rpm for 3 minutes using a HENSCHEL mixer (HENSCHEL 20B, manufactured by Mitsui Mining Co., Ltd.). Then, it was kneaded in a uniaxial kneading machine (Compact Buss Co-Kneader, manufactured by Buss, Inc.) under conditions of setting temperatures at an inlet of 90° C. and an outlet of 60° C. and a feed rate of 10 kg/hr. Thereby, (Masterbatch 11) was obtained.

Example 9

Production of Masterbatch 12

First, 12 parts by mass of a rhodamine pigment (7050, manufactured by Daido Chemical Corporation) and 88 parts by mass of (Resin for Masterbatch 3) were mixed at 1,500 rpm for 3 minutes using a HENSCHEL mixer (HENSCHEL 20B, manufactured by Mitsui Mining Co., Ltd.). Then, it was kneaded in a uniaxial kneading machine (Compact Buss Co-Kneader, manufactured by Buss, Inc.) under conditions of setting temperatures at an inlet of 90° C. and an outlet of 60° C. and a feed rate of 10 kg/hr. Thereby, (Masterbatch 12) was obtained.

Example 10

Production of Masterbatch 13

First, 8 parts by mass of a rhodamine pigment (7050, manufactured by Daido Chemical Corporation) and 92 parts by mass of (Resin for Masterbatch 3) were mixed at 1,500 rpm for 3 minutes using a HENSCHEL mixer (HENSCHEL 20B, manufactured by Mitsui Mining Co., Ltd.). Then, it was kneaded in a uniaxial kneading machine (Compact Buss Co-Kneader, manufactured by Buss, Inc.) under conditions of setting temperatures at an inlet of 90° C. and an outlet of 60° C. and a feed rate of 10 kg/hr. Thereby, (Masterbatch 13) was obtained.

Example 11

Production of Wax Dispersion

A reactor equipped with a cooling tube, a thermometer and a stirrer was charged with 20 parts by mass of paraffin wax (HNP-9 (melting point: 75° C.), manufactured by Nippon Seiro Co., Ltd.) and 80 parts by mass of ethyl acetate, which was heated to 78° C. After sufficiently dissolved, it was cooled to 30° C. over 1 hour with stirring. Thereafter, in ULTRA VISCO MILL (manufactured by Aimex Co., Ltd.) packed by 80% by volume with 0.5-mm zirconia beads, it was subjected to wet-milling by running 6 passes under conditions of a liquid feed rate of 1.0 kg/hr and a peripheral speed of a disc of 10 m/sec. Thereby, (Wax Dispersion) was obtained.

[Production of Organically Modified Layered Inorganic Mineral Masterbatch]

First, 100 parts by mass of (Polyester Resin 1), 100 parts by mass of a montmorillonite compound modified by a quaternary ammonium salt at least partially including a benzyl group (CLAYTON APA, manufactured by Southern Clay Products, Inc.) and 50 parts by mass of ion-exchanged water were mixed well. Then, the mixture was kneaded in an open roller kneader (KNEADEX, manufactured by Nippon Coke & Engineering. Co., Ltd.). As a kneading temperature, the kneading started from 90° C., and thereafter, it was gradually cooled to 50° C. Thereby, (Organically Modified Layered Inorganic Mineral Masterbatch) having a ratio of the resin and the inorganic mineral (mass ratio) of 1:1 was prepared.

[Production of Toner 1]

A reactor equipped with a thermometer and a stirrer was charged with 70 parts by mass of (Polyester Resin 1) and 70 parts by mass of ethyl acetate for sufficient dissolution. Then, 30 parts by mass of (Wax Dispersion), 2 parts by mass of (Organically Modified Layered Inorganic Mineral Masterbatch), 36.5 parts by mass of (Masterbatch 2) and 37 parts by mass of ethyl acetate were added therein and stirred at a rotational speed of 10,000 rpm by a TK HOMOMIXER (manufactured by Primix Corporation) for uniform dissolution or dispersion. Thereby, (Oil Phase 1) was obtained.

Next, in a separate reactor equipped with a stirrer and a thermometer, 90 parts by mass of ion-exchanged water, 3 parts by mass of a 5-% by mass aqueous solution of a nonionic surfactant of polyoxyethylene lauryl ether (NL450, manufactured by Dai-ichi Kogyo Seiyaku Co., Ltd.) and 10 parts by mass of ethyl acetate were mixed and stirred, and thereby an aqueous-phase solution was prepared. The obtained aqueous-phase solution was mixed with an addition of 50 parts by mass of (Oil Phase 1) at a rotational speed of 13,000 rpm for 1 minute by a TK HOMOMIXER (manufactured by Primix Corporation). Thereby, (Emulsified Slurry 1) was obtained. A container equipped with a stirrer was charged with (Emulsified Slurry 1) for desolvation for 6 hours. Thereby, (Slurry 1) was obtained. A filter cake was obtained by subjecting 100 parts by mass of obtained (Slurry 1) to vacuum filtration, and the obtained filter cake was subjected to the following washing treatment.

(1) 100 parts by mass of ion-exchanged water was added to the filter cake, which was mixed by a TK HOMOMIXER (at a rotational speed of 6,000 rpm for 5 minutes) and then filtered.

(2) 100 parts by mass of a 10-% by mass aqueous solution of sodium hydroxide was added to the filter cake of (1), which was mixed with by a TK HOMOMIXER (at a rotational speed of 6,000 rpm for 10 minutes) followed by vacuum filtration.

(3) 100 parts by mass of a 10-% by mass of hydrochloric acid was added to the filter cake of (2), which was mixed with by a TK HOMOMIXER (at a rotational speed of 6,000 rpm for 5 minutes) and then filtered.

(4) 300 parts by mass of ion-exchanged water was added to the filter cake of (3), which was mixed with by a TK HOMOMIXER (at a rotational speed of 6,000 rpm for 5 minutes) and then filtered. This operation was carried out twice, and (Filter Cake 1) was obtained.

Obtained (Filter Cake 1) was dried at 45° C. for 48 hours in a wind dryer. Thereafter, it was sieved with a mesh having openings of 75 μm, and (Toner Base Particles 1) were prepared.

Next, 100 parts by mass of obtained (Toner Base Particles 1) was mixed with 1.0 part by mass of hydrophobic silica (HDK-2000, manufactured by Wacker Chemie) using a HENSCHEL mixer, and (Toner 1) having a volume-average particle diameter of 5.8 μm was prepared.

Examples 12 to 20 and Comparative Examples 4, 5, 7

Table 2-1 and Table 2-2 below show types of the masterbatches and amounts of the resins for a masterbatch used in the examples and comparative examples.

(Toners 2 to 10, 14, 15, 17) were obtained by the same method as Example 11 except that the type of the masterbatch and the amount of the resin for a masterbatch were changed in Examples 12 to 20 and Comparative Examples 4, 5, 7, respectively.

Example 21

Production of Toner 11

A reactor equipped with a thermometer and a stirrer was charged with 70 parts by mass of (Crystalline Resin 1) and 70 parts by mass of ethyl acetate, which was heated above the melting point of the resin for sufficient dissolution. Then, 30 parts by mass of (Wax Dispersion), 2 parts by mass of (Organically Modified Layered Inorganic Mineral Masterbatch), 37 parts by mass of (Masterbatch 4) and 37 parts by mass of ethyl acetate were added, and at 50° C., it was stirred at a rotational speed of 10,000 rpm by a TK HOMOMIXER (manufactured by Primix Corporation) for uniform dissolution or dispersion. Thereby, (Oil Phase 11) was obtained. Here, the temperature of (Oil Phase 11) was maintained at 50° C. in a container, and it was used within 5 hours from the production to avoid crystallization.

Next, 90 parts by mass of ion-exchanged water, 3 parts by mass of a 5-% by mass aqueous solution of a nonionic surfactant of polyoxyethylene lauryl ether (NL450, manufactured by Dai-ichi Kogyo Seiyaku Co., Ltd.), and 10 parts by mass of ethyl acetate were mixed and stirred at 40° C. in a separate reactor equipped with a stirrer and a thermometer to prepare an aqueous-phase solution. To the obtained aqueous-phase solution, 50 parts by mass of (Oil Phase 11) maintained at 50° C. was added, and it was mixed at 40° C. to 50° C. in a TK HOMOMIXER (manufactured by Primix Corporation) at a rotational speed of 13,000 rpm for 1 minute. Thereby, (Emulsified Slurry 11) was obtained.

A container equipped with a stirrer and a thermometer was charged with (Emulsified Slurry 11) for desolvation at 60° C. for 6 hours. Thereby, (Slurry 11) was obtained.

A filter cake was obtained by subjecting 100 parts by mass of (Slurry 11) to vacuum filtration, and the obtained filter cake was subjected to the following washing treatment.

(1) 100 parts by mass of ion-exchanged water was added to the filter cake, which was mixed by a TK HOMOMIXER (at a rotational speed of 6,000 rpm for 5 minutes) and then filtered.

(2) 100 parts by mass of a 10-% by mass aqueous solution of sodium hydroxide was added to the filter cake of (1), which was mixed with by a TK HOMOMIXER (at a rotational speed of 6,000 rpm for 10 minutes) followed by vacuum filtration.

(3) 100 parts by mass of a 10-% by mass of hydrochloric acid was added to the filter cake of (2), which was mixed with by a TK HOMOMIXER (at a rotational speed of 6,000 rpm for 5 minutes) and then filtered.

(4) 300 parts by mass of ion-exchanged water was added to the filter cake of (3), which was mixed with by a TK HOMOMIXER (at a rotational speed of 6,000 rpm for 5 minutes) and then filtered. This operation was carried out twice, and (Filter Cake 11) was obtained.

Obtained (Filter Cake 11) was dried at 45° C. for 48 hours in a wind dryer. Thereafter, it was sieved with a mesh having openings of 75 μm, and (Toner Base Particles 11) were prepared.

Next, 1.0 part by mass of hydrophobic silica (HDK-2000, manufactured by Wacker Chemie) was mixed in 100 parts by mass of obtained (Toner Base Particles 11) using a HENSCHEL mixer, and (Toner 11) having a volume-average particle diameter of 5.8 μm was prepared.

Example 22

Production of Toner 12

(Toner 12) was produced in the same manner as Example 21 except that the crystalline resin used was changed from (Crystalline Resin 1) in Example 21 to (Crystalline Resin 2).

Example 23

Production of Toner 13

A reactor equipped with a thermometer and a stirrer was charged with 50 parts by mass of (Crystalline Resin 2) and 50 parts by mass of ethyl acetate, which was heated above the melting point of the resin for sufficient dissolution. Then, 30 parts by mass of (Wax Dispersion), 2 parts by mass of (Organically Modified Layered Inorganic Mineral Masterbatch), 57 parts by mass of (Masterbatch 11) and 57 parts by mass of ethyl acetate were added, and at 50° C., it was stirred at a rotational speed of 10,000 rpm by a TK HOMOMIXER (manufactured by Primix Corporation) for uniform dissolution or dispersion. Thereby, (Oil Phase 13) was obtained. Here, the temperature of (Oil Phase 13) was maintained at 50° C. in a container, and it was used within 5 hours from the production to avoid crystallization.

Thereafter, (Toner 13) was produced in the same manner as Example 21.

Comparative Example 6

First, 100 parts by mass of (Polyester Resin 1) and 100 parts by mass of ethyl acetate were placed in a reactor equipped with a thermometer and a stirrer and sufficiently dissolved. To this, 30 parts by mass of (Wax Dispersion), 2 parts by mass of (Organically Modified Layered Inorganic Mineral Masterbatch) and 6.5 parts by mass of a rhodamine pigment (7050, manufactured by Daido Chemical Corporation) were added and stirred at a rotational speed of 10,000 rpm by a TK HOMOMIXER (manufactured by Primix Corporation) for uniform dissolution or dispersion. Thereby, (Oil Phase 16) was obtained. Thereafter, (Toner 16) was produced in the same manner as Example 11.

(Production of Carrier)

Carriers used in two-component developers of examples and comparative examples were produced as follows.

As a core material, 5,000 parts by mass of Mn ferrite particles (weight-average diameter: 35 μm) were used. As a coating material, a coating solution prepared by dispersing 450 parts by mass of toluene, 450 parts by mass of a silicone resin SR2400 (manufactured by Dow Corning Toray Co., Ltd., non-volatile content of 50% by mass), 10 parts by mass of an aminosilane SH6020 (manufactured by Dow Corning Toray Co., Ltd.) and 10 parts by mass of carbon black by a stirrer for 10 minutes was used. The core material and the coating solution were placed in a coating apparatus equipped with a rotary bottom plate disc and a stirring blade, where coating is carried out while forming a swirling flow in a fluidized bed, and the coating solution was applied on the core material. An obtained coated matter was baked in an electric furnace at 250° C. for 2 hours. Thereby, (Carrier) was obtained.

(Production of Two-Component Developer)

First, 7 parts by mass of the toners obtained in the examples or the comparative examples were uniformly mixed and charged respectively with 100 parts by mass of (Carrier) using a TURBULA mixer that a container rolls for stirring (manufactured by Willy A. Bachofen AG Maschinenfabrik (WAB)) at 48 rpm for 3 minutes. In the present embodiment, the mixing was carried out by placing 200 g of the carrier and 14 g of the toner in a stainless-steel container having an internal volume of 500 mL.

Obtained two-component developers were loaded in a developing unit of a tandem image forming apparatus for image formation, which adopts an indirect transfer method with a contact charging method, a two-component developing system, an indirect transfer method, a secondary transfer method, a blade cleaning method and an externally heated roller fixing method. Performances of the toners and the developers were evaluated by evaluating the obtained images.

[Measurement Method and Evaluation of Various Physical Property Values]

<Separation of Resin from Toner>

Resin components included in a toner may be separated using a difference in solubility. Specifically, the toner is added in tetrahydrofuran (THF), the colorant and the external additive are removed, and an obtained solution is concentrated. Thereafter, an obtained resin composition is dissolved in ethyl acetate, and thereby the crystalline polyester resin as an insoluble component may be separated. Since the crystalline polyester resin has low solubility to a polar solvent, it exists as an insoluble component right after it is added in ethyl acetate. The binder resin of the non-crystalline resin and the resin for a masterbatch are initially soluble in ethyl acetate, but the resin for a masterbatch becomes insoluble over time. Thus, by separating a component precipitated after the resin composition is added with ethyl acetate and left to stand, the binder resin of the non-crystalline resin and the resin for a masterbatch may be separated. By the above procedure, the binder resin (crystalline resin), the binder resin (non-crystalline resin) and the resin for a masterbatch included in the toner may be separated.

<Measurement of Molecular Weight>

A measurement apparatus and measurement conditions of the molecular weight were as follows.

Apparatus: GPC (manufactured by Tosoh Corporation)

Detector: RI

Measurement temperature: 40° C.

Mobile phase: tetrahydrofuran,

Flow rate: 0.45 mL/min,

Molecular weights (Mn and Mw) were obtained by GPC (gel permeation chromatography) with a calibration curve created using polystyrene samples having known molecular weights as a standard.

<Measurement of Glass Transition Temperature (Tg)>

As a measurement apparatus of the glass transition temperature, the following apparatus was used.

Apparatus: DSC (Q2000, manufactured by TA Instruments)

The glass transition temperature was measured by subjecting 5 mg to 10 mg of a measurement sample filled in a simple sealed pan made of aluminum to the following measurement procedure.

First heating: it was heated from 30° C. to 220° C. at a heating rate of 5° C./min and maintained for 1 minute;

Cooling: it was quenched to −60° C. without temperature control and maintained for 1 minute;

Second heating: it was heated from −60° C. to 180° C. at a heating rate of 5° C./min.

Here, as the glass transition temperature, a glass transition temperature read from a thermogram of the second heating based on a midpoint method described by ASTM D3418/82 was measured.

<Measurement of Transmittance>

A measurement apparatus and measurement conditions of the transmittance were as follows.

Apparatus: Spectrophotometer (JASCO V660)

Measurement container: glass cell (optical path length: 1 cm)

Start wavelength: 800 nm

End wavelength: 350 nm

Scanning speed: 200 nm/min (continuous)

Data acquisition interval: 1 nm

Blank: Ethyl acetate alone

A measurement method of the transmittance was the above-described method.

<Minimum Fixing Temperature (Low-Temperature Fixing Property)>

Using the above-described image forming apparatus, a solid image having a toner adhered amount after transfer of 0.85±0.1 mg/cm$^2$ (image size: 3 cm×8 cm) was created on transfer paper (Copy Printing Paper <70>, manufactured by Ricoh Business Expert Co., Ltd.). It was fixed with a temperature of the fixing belt varied, and drawing was carried out on a surface of an obtained fixed image using a drawing tester AD-401 (manufactured by Ueshima Seisakusho Co., Ltd.) with a ruby needle (tip radius: 260 μm R to 320 μm R; tip angle: 60°) and a load of 50 g. The drawing surface was strongly rubbed five (5) times with fiber (HANICOT #440, manufactured by Haniron K.K.), and a fixing belt temperature at which almost no chipping of the image occurred was defined as a minimum fixing temperature. Here, the solid image was created on the transfer paper at a position of 3.0 cm from a tip thereof in a paper-feeding direction. Also, a speed through a nip portion of the fixing apparatus was 280 mm/s.

<Heat-Resistant Storage Stability>

A toner was filled in a 50-mL glass container, allowed to stand in a thermostatic chamber at 50° C. for 24 hours and cooled to 24° C. A penetration (mm) of the obtained toner was measured by a penetration test (JIS K2235-1991), and heat-resistant storage stability was evaluated based on the following criteria. Here, larger penetration indicates superior heat-resistant storage stability, and a toner having penetration of less than 5 mm has a high possibility of causing a problem in use.

The evaluation criteria were as follows.

A: The penetration was 20 mm or greater.

B: The penetration was 10 mm or greater and less than 20 mm.

C: The penetration was 5 mm or greater and less than 10 mm.

D: The penetration was less than 5 mm.

<Evaluation Method of Pigment Dispersibility>

Pigment dispersibility was evaluated based on the following evaluation criteria.

Evaluation Criteria

A: The pigment was uniformly dispersed in the toner.

B: The pigment was uniformly dispersed, but a part of the pigment is unevenly distributed on the surface of the toner.

C: The entire pigment was unevenly distributed on the surface of the toner.

Table 2-1 and Table 2-2 show evaluation results.

TABLE 2-1

| | | Binder resin | Masterbatch type |
|---|---|---|---|
| Ex. 11 | Toner 1 | Polyester Resin 1 | 2 |
| Ex. 12 | Toner 2 | Polyester Resin 1 | 3 |
| Ex. 13 | Toner 3 | Polyester Resin 1 | 4 |
| Ex. 14 | Toner 4 | Polyester Resin 1 | 6 |
| Ex. 15 | Toner 5 | Polyester Resin 1 | 7 |
| Ex. 16 | Toner 6 | Polyester Resin 1 | 8 |
| Ex. 17 | Toner 7 | Polyester Resin 1 | 9 |
| Ex. 18 | Toner 8 | Polyester Resin 1 | 11 |
| Ex. 19 | Toner 9 | Polyester Resin 1 | 12 |
| Ex. 20 | Toner 10 | Polyester Resin 1 | 13 |
| Ex. 21 | Toner 11 | Crystalline Resin 1 | 4 |
| Ex. 22 | Toner 12 | Crystalline Resin 2 | 4 |
| Ex. 23 | Toner 13 | Crystalline Resin 2 | 11 |

TABLE 2-1-continued

| | | Binder resin | Masterbatch type |
|---|---|---|---|
| Comp. Ex. 4 | Toner 14 | Polyester Resin 1 | 1 |
| Comp. Ex. 5 | Toner 15 | Polyester Resin 1 | 5 |
| Comp. Ex. 6 | Toner 16 | Polyester Resin 1 | — |
| Comp. Ex. 7 | Toner 17 | Polyester Resin 1 | 10 |

TABLE 2-2

| | | Amount of resin for masterbatch used (parts by mass) | Pigment dispersibility | Heat-resistant storage stability | Minimum fixing temperature (° C.) |
|---|---|---|---|---|---|
| Ex. 11 | Toner 1 | 30 | A | A | 140 |
| Ex. 12 | Toner 2 | 30 | A | A | 140 |
| Ex. 13 | Toner 3 | 30 | A | B | 135 |
| Ex. 14 | Toner 4 | 30 | B | B | 135 |
| Ex. 15 | Toner 5 | 30 | B | B | 135 |
| Ex. 16 | Toner 6 | 30 | A | C | 130 |
| Ex. 17 | Toner 7 | 30 | A | A | 140 |
| Ex. 18 | Toner 8 | 10 | B | A | 130 |
| Ex. 19 | Toner 9 | 50 | A | A | 130 |
| Ex. 20 | Toner 10 | 70 | A | A | 130 |
| Ex. 21 | Toner 11 | 30 | B | A | 105 |
| Ex. 22 | Toner 12 | 30 | B | A | 105 |
| Ex. 23 | Toner 13 | 50 | B | A | 115 |
| Comp. Ex. 4 | Toner 14 | 30 | C | A | 140 |
| Comp. Ex. 5 | Toner 15 | 30 | C | B | 130 |
| Comp. Ex. 6 | Toner 16 | 0 | C | B | 140 |
| Comp. Ex. 7 | Toner 17 | 30 | C | C | 130 |

In Table 2-2, "Amount of resin for masterbatch used" denotes an amount used in a toner with respect to 100 parts by mass of a total amount of a binder resin and a resin for a masterbatch.

The toner including the resin composition of the present embodiment has superior dispersibility of the colorant and superior heat-resistant storage stability and low-temperature fixing property.

REFERENCE SIGNS LIST a Process cartridge
b Photoconductor
c Charging unit
d Developing unit
e Cleaning unit
100 Copying apparatus main body
200 Paper feed table
300 Scanner
400 Automatic document feeder

The invention claimed is:

1. A resin composition, comprising:

a polyester resin prepared from monomers comprising an aliphatic alcohol and an aromatic carboxylic acid; and a colorant, wherein the aliphatic alcohol comprises propylene glycol and 1,3-propanediol, where a molar ratio of propylene glycol with respect to a total of propylene glycol and 1,3-propanediol is from 65% to 85%, the aromatic carboxylic acid comprises terephthalic acid, and the polyester resin has a A(10)-A(180) value of 70 or greater, where A(10) (%) is a transmittance of light having a wavelength of 500 nm through a mixture obtained by adding 20 parts by mass of the polyester resin to 80 parts by mass of ethyl acetate and stirring at 25° C. for 10 minutes, and A(180) (%) is the transmittance after the mixture is left to stand for 3 hours.

2. The resin composition according to claim 1, wherein A(10) is 90 or greater, and A(180) is 10 or less.

3. The resin composition according to claim 1, wherein the polyester resin has a glass transition temperature of 55° C. or greater.

4. The resin composition according to claim 1, wherein the aromatic carboxylic acid further comprises isophthalic acid.

5. The resin composition according to claim 1, wherein the polyester resin has a glass transition temperature of 64° C. or greater.

6. The resin composition according to claim 1, wherein the polyester resin has a glass transition temperature of 66° C. or greater.

7. The resin composition according to claim 1, wherein A(10) is 95 or greater.

8. A toner, comprising:

a first polyester resin prepared from monomers comprising an aliphatic alcohol and an aromatic carboxylic acid; and a colorant, wherein the aliphatic alcohol comprises propylene glycol and 1,3-propanediol, where a molar ratio of propylene glycol with respect to a total of propylene glycol and 1,3-propanediol is from 65% to 85%, the aromatic carboxylic acid comprises terephthalic acid, and the first polyester resin has a A(10)-A(180) value of 70 or greater, where A(10) (%) is a transmittance of light having a wavelength of 500 nm through a mixture obtained by adding 20 parts by mass of the first polyester resin to 80 parts by mass of ethyl acetate and stirring at 25° C. for 10 minutes, and A(180) (%) is the transmittance after the mixture is left to stand for 3 hours.

9. The toner according to claim 8, further comprising:

a second polyester resin, wherein the second polyester resin has A(10) of 90 or greater and A(180) of 90 or greater, where A(10) (%) is a transmittance of light having a wavelength of 500 nm through a mixture obtained by adding 20 parts by mass of the second polyester resin to 80 parts by mass of ethyl acetate and stirring at 25° C. for 10 minutes, and A(180) (%) is the transmittance after the mixture is left to stand for 3 hours.

10. The toner according to claim 9, wherein a content by mass of the first polyester resin to a content by mass of the second polyester resin is in a range of 5/95 to 70/30.

11. The toner according to claim 8, further comprising:

a crystalline resin.

12. The toner according to claim 11, wherein a content of the crystalline resin with respect to a total amount of the resins in the toner is 50% by mass or greater.

13. The toner according to claim 11, wherein the crystalline resin comprises a crystalline polyester resin.

14. A developer, comprising:

the toner according to claim 8; and a carrier.

15. The toner according to claim 8, wherein the aromatic carboxylic acid further comprises isophthalic acid.

16. The toner according to claim 8, wherein A(10) is 90 or greater, and A(180) is 10 or less.

17. The toner according to claim 8, wherein the first polyester resin has a glass transition temperature of 55° C. or greater.

18. The toner according to claim 8, wherein the first polyester resin has a glass transition temperature of 64° C. or greater.

19. The toner according to claim 8, wherein the first polyester resin has a glass transition temperature of 66° C. or greater.

20. The toner according to claim 8, wherein A(10) is 95 or greater.

* * * * *